US007070438B2

(12) United States Patent
Dillon

(10) Patent No.: US 7,070,438 B2
(45) Date of Patent: Jul. 4, 2006

(54) CONNECTOR LEVER LOCK

(75) Inventor: Christopher J. Dillon, Farmington Hills, MI (US)

(73) Assignee: JST Corporation, Farmington Hills, MI (US)

( * ) Notice: Subject to any disclaimer, the term of this patent is extended or adjusted under 35 U.S.C. 154(b) by 0 days.

(21) Appl. No.: 10/995,424

(22) Filed: Nov. 24, 2004

(65) Prior Publication Data

US 2005/0221653 A1 Oct. 6, 2005

Related U.S. Application Data

(63) Continuation-in-part of application No. 10/812,927, filed on Mar. 31, 2004, now Pat. No. 6,971,894.

(51) Int. Cl.
*H01R 13/625* (2006.01)

(52) U.S. Cl. ..... 439/347; 439/372; 439/157

(58) Field of Classification Search ..... 439/157, 439/347, 372

See application file for complete search history.

(56) References Cited

U.S. PATENT DOCUMENTS

| | | | |
|---|---|---|---|
| 2,987,693 | A | 6/1961 | Wamsley |
| 3,059,206 | A | 10/1962 | Williams |
| 3,488,622 | A | 1/1970 | Gley |
| 3,801,757 | A | 4/1974 | Carissimi et al. |
| 3,836,938 | A | 9/1974 | Barrett, Jr. et al. |
| 5,172,998 | A | 12/1992 | Hatagishi |
| 5,230,635 | A | 7/1993 | Takenouchi et al. |
| 5,308,255 | A | 5/1994 | Yamanashi |
| 5,330,362 | A | 7/1994 | Ito et al. |
| 5,344,194 | A | 9/1994 | Hatagishi et al. |
| 5,380,217 | A | 1/1995 | Yagi et al. |
| 5,401,179 | A | 3/1995 | Shinchi et al. |
| 5,417,513 | A | 5/1995 | Hayashi |
| 5,474,461 | A | 12/1995 | Saito et al. |
| 5,499,926 | A | 3/1996 | Akeda |
| 5,562,465 | A | 10/1996 | Taguchi et al. |
| 5,575,672 | A | 11/1996 | Katsuma |
| 5,595,492 | A | 1/1997 | Taguchi |
| 5,603,624 | A | 2/1997 | Taguchi et al. |
| 5,609,494 | A | 3/1997 | Yamaguchi et al. |
| 5,611,703 | A | 3/1997 | Okamoto et al. |
| 5,624,272 | A | 4/1997 | Ohsumi |
| 5,630,727 | A | 5/1997 | Kameyama |
| 5,634,804 | A | 6/1997 | Steinhauser et al. |
| 5,637,003 | A | 6/1997 | Takahashi |
| 5,664,961 | A | 9/1997 | Tsuji et al. |

(Continued)

*Primary Examiner*—Ross Gushi
(74) *Attorney, Agent, or Firm*—Nixon Peabody LLP; Donald R. Studebaker

(57) ABSTRACT

A lever-type connector assembly reduces connection mating forces between connector halves. The assembly employs a first connector with cam follower projections, a base housing with guide channels and a latch member, a slide cam housing including cam grooves and projection guide tracks, and a cover housing pivoting on the base housing, the cover housing having a cover housing projection and release latch. The release latch is fully protected and concealed within the profile of the cover housing. As the cover housing rotates, the cover housing projection engages in projection guide track, thereby moving slide cam housing in a guide channel. As slide cam housing moves from an open to a closed position, it engages cam follower projections in cam grooves thereby drawing first connector into base housing to a connected position while the cover housing release latch engages base housing release latch aperture to provide a secure electrical connection.

50 Claims, 16 Drawing Sheets

U.S. PATENT DOCUMENTS 5,672,068 A 9/1997 Tsuchiya et al.
5,676,556 A 10/1997 Yamaguchi et al.
5,695,349 A 12/1997 Taguchi et al.
5,709,560 A 1/1998 Hio
5,711,682 A 1/1998 Maejima
5,810,612 A 9/1998 Flask et al.
5,823,808 A 10/1998 Clark et al.
5,823,809 A 10/1998 Wakata
5,833,484 A 11/1998 Post et al.
5,928,010 A 7/1999 Katsuma et al.
5,947,762 A 9/1999 Katsuma
5,957,710 A 9/1999 Nagano
5,971,779 A 10/1999 Okabe
5,975,928 A 11/1999 Tsuji
5,980,283 A 11/1999 Okabe
5,997,321 A 12/1999 Nakata et al.
6,012,933 A 1/2000 Katsuma
6,019,620 A 2/2000 Kodama et al.
6,030,235 A 2/2000 Ittah et al.
6,056,582 A 5/2000 Okabe
6,065,982 A 5/2000 Okabe
6,086,392 A 7/2000 Okabe
6,099,330 A 8/2000 Gundermann et al.
6,132,233 A 10/2000 Fukuda
6,164,992 A 12/2000 Okabe
6,174,179 B1 1/2001 Okabe
6,183,282 B1 2/2001 Okabe
6,190,187 B1 2/2001 Okabe et al.
6,241,540 B1 6/2001 Tokuwa
6,312,273 B1 11/2001 Hasegawa et al.
6,319,050 B1 11/2001 Miyazaki et al.
6,325,647 B1 12/2001 May et al.
6,328,582 B1 12/2001 Fukamachi
6,345,995 B1 * 2/2002 Bigotto et al. ..... 439/157
6,439,902 B1 8/2002 Cole et al.
6,485,317 B1 11/2002 Gundermann et al.
6,517,364 B1 2/2003 Muramatsu et al.
6,540,532 B1 4/2003 Martin et al.
6,551,118 B1 4/2003 Langolf et al.
6,558,176 B1 5/2003 Martin et al.
6,602,082 B1 8/2003 Nishide et al.
6,619,978 B1 9/2003 Okabe et al.
6,623,287 B1 9/2003 Hatagishi et al.
6,641,423 B1 * 11/2003 Giro ..... 439/347
6,655,971 B1 12/2003 Maegawa
6,679,711 B1 1/2004 Takahashi
6,682,359 B1 1/2004 Hitchcock et al.
6,692,274 B1 2/2004 Maegawa
2002/0104396 A1 8/2002 Megason et al.
2002/0177338 A1 11/2002 Nishide et al.
2003/0017733 A1 1/2003 Fujii
2003/0054681 A1 3/2003 Hatagishi et al.
2003/0162426 A1 8/2003 Shinozaki et al.
2003/0162427 A1 8/2003 Shinozaki et al.
2003/0166351 A1 9/2003 Shinozaki et al.
2003/0199185 A1 10/2003 Fujii et al.

* cited by examiner

CONNECTOR LEVER LOCK

CROSS-REFERENCE TO RELATED APPLICATIONS

This non-provisional application is a continuation-in-part of related application Ser. No. 10/812,927 filed on Mar. 31, 2004 now U.S. Pat. No. 6,971,894. The present application claims benefit of priority to application Ser. No. 10/812,927, the disclosures of that application and others referenced therein are incorporated herein by reference.

FIELD OF THE INVENTION

The invention relates generally to electrical connector assemblies. More particularly, the invention relates to an electrical connector assembly with a locking lever mechanism to securely mate and un-mate the connectors with a reduced mating force while preventing the inadvertent release of the connectors and misalignment during mating.

BACKGROUND OF THE INVENTION

Electrical connector assemblies used in automotive and other applications often employ a large number of terminals and therefore require a large mating force to ensure a secure connection between the male and female connectors. Significant frictional forces from the terminals and housings must be overcome to properly join the connectors. Similarly, in order to properly function in the environment for which they were created, the male and female connectors must be secured to ensure the electrical connection does not become disengaged, thereby opening the electrical circuit.

Conventional electrical connectors have employed locking devices consisting of screws, springs, detents, clasps, bayonet mechanisms, and other means to assist in securing electrical connectors and preventing accidental uncoupling. However, many of these locking means have been unwieldy and often physically extend beyond the primary geometric bounds of the electrical connector package. The large geometry of previous connectors have prevented their use in constrained spaces.

While methods of securing electrical connectors have been employed in the past, problems occur when the connectors are not properly aligned prior to applying the mating force, or when the connectors become misaligned as the mating force is applied, or when the connector locking mechanism is not properly secured. This can result from improper initial alignment of the connectors, as well as misalignment due to a fluctuating or an inconsistent applied force that results in skewing or otherwise improper closing of the locking mechanism. Prior attempts to overcome these challenges have fallen short in suitably addressing both concerns simultaneously. That is, there is a lack of a suitable locking mechanism that may be used to securely fasten an electrical connector assembly employing large mating forces while preventing unintentional separation of the assembly.

For example, U.S. Pat. No. 5,997,321 appears to disclose an electrical connector with a C-shaped lever that is pivotally mounted at opposite sides of the connector body on a common axis. An operating member links the arms for arcuate movement, and the operating member and body have a releasable flexible latch that may be engaged to hold the operating member at one end of arcuate travel. A support member is adapted to prevent the lever from flexing that could cause the latch to inadvertently release. However, the '321 patent requires an arc-shaped inclining face that corresponds closely to the locking mechanism path of movement to actuate the locking mechanism. Additionally, the '321 patent fails to disclose a lever latch that operates and is housed within the geometrical projection of the operating member that suitably aligns the entire connector assembly during the mating action. The locking mechanism disclosed in the '321 patent employs a physical package that extends well-beyond the geometry of the connector itself. Further, the '321 patent fails to disclose a connector lock mechanism that secures the electrical connection while simultaneously guarding against actuation of the cam mechanism when the connector is not properly mated.

Additionally, U.S. Pat. No. 5,637,003 appears to disclose an electrical lever style connector employing fixing shafts on both lateral sides of one connector and a pivoting retaining lever on the other half of the connector. The retaining lever has curved rails on the front end. When the fixed shaft connector is inserted into the retaining lever connector, shaft portions of the fixing shafts abut the rails to produce resisting forces that cause the rails to pivot about the fixing shafts. A lever lock includes an elastically deformable lock plate that extends up from the outer surface of the housing. The lever lock has side walls that span an elastic lock plate. However, the '003 patent fails to disclose a lever lock that operates within the geometrical projection of a cover housing. Additionally, the '003 patent fails to disclose an operating member that aligns the connector assembly during mating while preventing actuation of the cam mechanism when the connector is not properly aligned.

U.S. Pat. Nos. 5,609,494 and 5,611,703 are two similar examples of electrical connector assemblies that appear to employ a camming system for mating and unmating a pair of electrical connectors.

The '703 patent discloses an engagement shaft formed on one of the connector halves and a retaining lever mounted on the opposite half for pivotal movement about a support shaft. The retaining lever is pivotally moved about the support shaft to force the engagement shaft in the fitting groove, thereby joining the connectors. A lock portion is formed on the front surface of the retaining lever, and a lock arm engages the opposite connector. In the '703 patent, the lock portion of the retaining lever has a long portion extending generally in the direction of pivotal movement of the retaining lever, and a slanting slide surface gently slanting upward and inward from an outer end of the long portion. The lock arm retaining piece portion of the lock arm has a long portion extending parallel to the fitting direction of the connectors and an outer edge at a lower end of the long portion of the lock arm retaining piece portion. The '703 patent discloses that when an impact force is accidentally applied to the retaining lever, the lock engagement is released to relieve the impact force, so that damage does not occur to the constituent parts. Yet the '703 patent fails to disclose an electrical connector with a secure lever lock mechanism that may withstand accidental impacts without disengaging and thereby opening the electrical circuit. Nor does the '703 patent disclose a lever lock assembly that is housed within the geometrical projection of a cover housing operating member that aligns the connector assembly during mating while preventing actuation of the cam mechanism when the connector is not properly aligned.

Similarly, the '494 patent discloses a lever locking mechanism that is engaged by moving a horizontal rod portion of an operation lever against the elastic force of a coil spring and by pressing the lever horizontal rod portion against a flexible locking portion to engage tapered guiding surfaces against locking projections. However, the '494 patent fails to disclose a lever lock that operates within the geometrical projection of a cover housing operating member that aligns the connector assembly during mating while preventing actuation of the cam mechanism when the connector is not properly aligned.

None of the previous electrical connector lever lock assemblies allow the use of large mating forces required to properly join male and female multi-pin connector structures while adequately preventing the unintentional release of the lever lock connector and providing a lever locking mechanism that operates within the geometric projection of the cover housing used to actuate proper connection of the halves of the electrical connector assembly to provide an efficient and reliable means of mating and locking the connector assembly.

What is needed is a new type of electrical connector lever lock assembly that permits application of suitably large mating forces during the mating process while providing a secure and stable locking mechanism for the connector after the mating process is complete.

SUMMARY OF THE INVENTION

The present invention relates to an electrical connector assembly and method for establishing and maintaining electrical contact between conductive members to be joined by employing a lever mechanism and cam system to securely mate and un-mate the connectors with a reduced mating force as a cover housing is rotated. The present invention provides a connector lock mechanism to prevent accidental release of the connection. The lever lock is shielded by the body of the cover housing to prevent deformation of the lever lock device at all points other than at the latch.

The present invention provides a simple, powerful, and inexpensive lever lock for an electrical connector assembly to securely and confidently join male and female electrical connector structures to ensure electrical continuity and complete electrical circuits. The lever lock mechanism provides a secure and verifiable means of assuring circuit completion. Likewise, the lever lock of the present invention provides a hold-open feature to safely and securely hold the connector in a fully-open position to prepare the housing for mating.

The task of securely and reliably joining multi-pin electrical connectors presents a difficult challenge as the number of pins increases and the corresponding required mating forces likewise increase. With large forces necessary, an alignment error of the male and female structures may result in inordinately high stress on individual pins resulting in cracked conductors or damaged insulators, as well as pushed pins that fail to meet and join a corresponding receptacle. Similarly, without means of ensuring the connector and housing are fully and properly mated, irregular and erratic performance of the electrical connector may occur. These maladies then result in faulty or intermittent connections and greatly increase product costs as extensive troubleshooting may be required to detect the faulty assembly once the product is assembled.

No previous connector assembly employs a lock assembly for a lever-type connector where the connector lock beams are contained within the confines of the lever housing walls and the lever lock is protected on all exterior surfaces of the connector while capitalizing on a unique slide cam housing geometry that employs a cam groove—cam follower combination to ensure the mating forces are applied along the proper mating axis and are substantially constant during the mating process.

The present lever-type electrical connector assembly invention reduces required connecting mating forces by employing a connector structure that includes cam follower projections. The housing assembly includes a base housing for receiving the connector structure. The base housing includes a pivot anchor and a guide channel for receiving legs of a slide cam housing. The slide cam housing includes a generally rectangular projection guide to accommodate a cover housing projection. The slide cam housing also has cam grooves on the slide cam legs that receive cam follower projections that are part of the connector. The cover housing is pivotally mounted on the base housing. The cover housing includes arms pivoted on opposite sides of the base housing on a common axis and an operating member linking the arms for arcuate movement of the cover housing. The cover housing operating member and the base housing each have a latch member, the latch members being releasably engageable with each other to hold the operating member at one extreme end of the arcuate movement. The base housing prevents flexing of the cover housing that would otherwise cause inadvertent release of the latch members when the lever is in a secured state. The slide cam housing is mounted on the base housing and includes a guide track for receiving the cover housing projection. The slide cam housing extends into the guide channel of the base housing.

The present invention eliminates alignment errors while simultaneously reducing the required mating forces by means of a lever assembly and camming system that provides a dual action mechanical assist to establish an intimate electrical connection between male and female connector structures. The present invention employs a novel lever lock mechanism that results in a secure and stable connection between housing and connector structures that prevents the inadvertent release of the joined connector assembly.

The method of the present invention allows users to securely and reliably mate and lock connectors and housings with large numbers of pins and high mating forces, while at the same time preventing alignment errors, eliminating intermittent connections, and improving reliability of the overall product.

The method of the present invention is carried out using a base housing comprising a guide channel and a latch member; a slide cam housing mounted on the base housing with cam grooves and a guide track, the slide cam housing extending into the guide channel; and a cover housing pivotally mounted on the base housing where the cover housing has a cover housing projection engaged in the projection guide track and a latch member to engage the base housing latch member. By rotating the cover housing from an open position to a closed position, the cover housing projection engages the projection guide track and the cover housing latch member and the base housing latch member. The slide cam housing moves from an open position to a closed position further engaging cam follower projections in cam grooves thereby drawing the connection member into the base housing to a connected position. An audible click, tactile feedback, or other sensory indication alerts a user that a connection has been completed.

BRIEF DESCRIPTION OF THE DRAWINGS

The above-mentioned and other features and objects of this invention and the manner of attaining them will become more apparent, and the invention itself will be better understood by reference to the following description of embodiments of the invention taken in conjunction with the accompanying figures where.

DETAILED DESCRIPTION OF THE INVENTION

The invention is described in detail with particular reference to certain preferred embodiments, but within the spirit and scope of the invention, it is not limited to such embodiments. It will be apparent to those of skill in the art that various features, variations, and modifications can be included or excluded, within the limits defined by the claims and the requirements of a particular use.

The present invention extends the functionality of current electrical connector assemblies by properly and consistently aligning multi-pin connectors and joining the structures with reduced mating forces. Once joined, the electrical connector assembly of the present invention is secured using the lever lock mechanism of the slide cam housing to ensure that the connection does not loosen or otherwise disconnect over time. This has many advantages over prior assemblies such as those providing simple cam slides, because the dual action mechanical assistance provided by the present invention significantly reduces the required mating forces while providing improved alignment consistency and a secure and locked connection by engaging the slide cam in the base housing using the lever lock mechanism.

FIG. 1 illustrates connector assembly 100 in a fully unmated state. It should be understood that in the following figures, connector housing H of the connector assembly 100 includes the lever lock mechanism of the present invention, but that the individual male and female connector structures may be reversed between connector housing H and connector C without changing the overall structure of the connector assembly 100 of the present invention. For brevity and convenience, reference will be made to housing H and connector C structures as depicted in FIG. 1A. The particular components of the housing H and connector C are illustrated in detail in FIGS. 1B–1E.

Figure 1A:
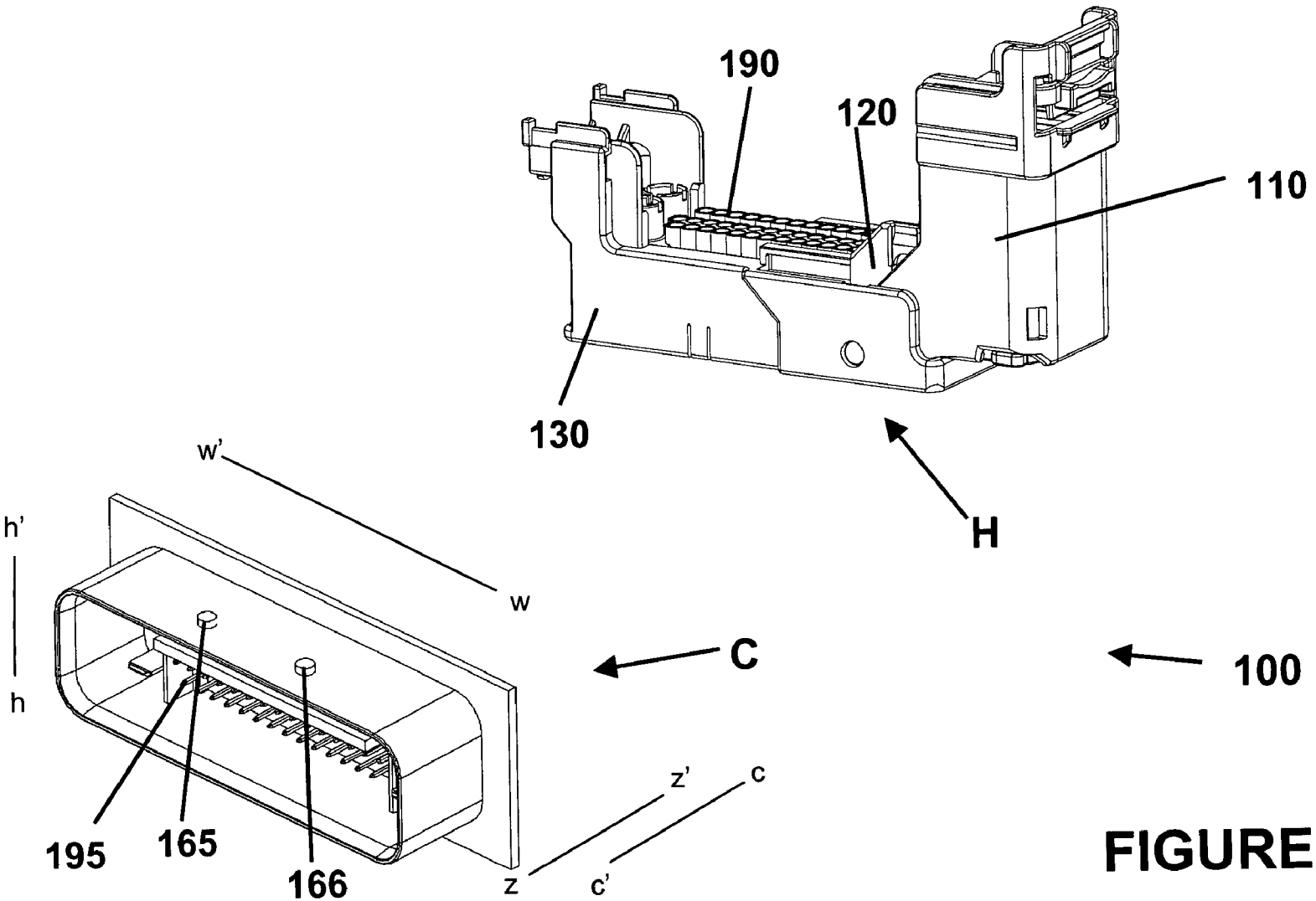
FIG. 1A is a perspective view of the connector assembly in accordance with the present invention shown in a fully open state.

FIG. 1A shows housing H and connector C. In connector C, electrical contact points 195 are formed through in the front to rear direction of connector C as illustrated by directional line z–z'. The electrical contact points 195 are formed parallel to each other in several rows in the height direction of the connector C as illustrated by directional line h–h' and in several columns in the width direction of the connector C as illustrated by directional line w–w'. An electric wire W (not shown) is connected to each electrical contact point 195. In housing H, chambers 190 are formed in a reciprocal fashion to accommodate the type of electrical contact point 195 utilized in connector C. The electrical contact points 195 may be made in any number of ways, including, but not limited to blade terminals, pin terminals, block terminals, edge connectors, and the like, as long as the chambers 190 on housing H and electrical contact points 195 on connector C form the two halves of the physical junction that join to complete an electrical circuit. Connector C also includes first cam follower projection 165 and second cam follower projection 166. Similarly, two corresponding cam follower projections are present on the underside of connector C (not shown), along the h–h' axis so that there are a total of two pairs of cam follower projections on connector C.

Housing H is made of an insulating material and forms the reciprocal side of connector assembly 100 and comprises a base housing 130. Base housing 130, best illustrated in FIG. 1D, has a first guide channel 133 formed to accept a first slide cam leg 150. A corresponding second guide channel is formed on the opposite side of base housing 130. The two guide channels are mirror images of each other about the center of the width of base housing 130. Base housing 130 includes chambers 190 formed in a reciprocal arrangement to join electrical contact points 195 on connector C. Chambers 190 may be arranged in parallel rows and columns as shown in FIG. 1D, or in any fashion to accommodate the joining of electrical contact points 195 on connector C. A slide cam housing 120, as shown in FIG. 1C includes the first slide cam leg 150. A corresponding second slide cam leg is formed on the opposite side of slide cam housing 120. The two slide cam legs are mirror images of each other about the center of the width of slide cam housing 120. Each slide cam leg 150 includes a first cam groove 152, a second cam groove 154, and a projection guide track 122, each of which accept cover housing projections 112. The cover housing projections 112 are formed as part of cover housing 110, one such projection illustrated in FIG. 1B, with the second projection extending from the opposing side of cover housing 110. Cover housing 110 is pivotally mounted on the base housing 130 and forms a protective cover shielding the point of electrical contact between connector C and housing H in connector assembly 100 as does the back wall 126 of slide cam housing 120. Optionally, connector C and housing H may also be lined with a flexible impervious material to prevent liquid and vapor from reaching the electrical connection point of contact when assembled.

Figure 1B:
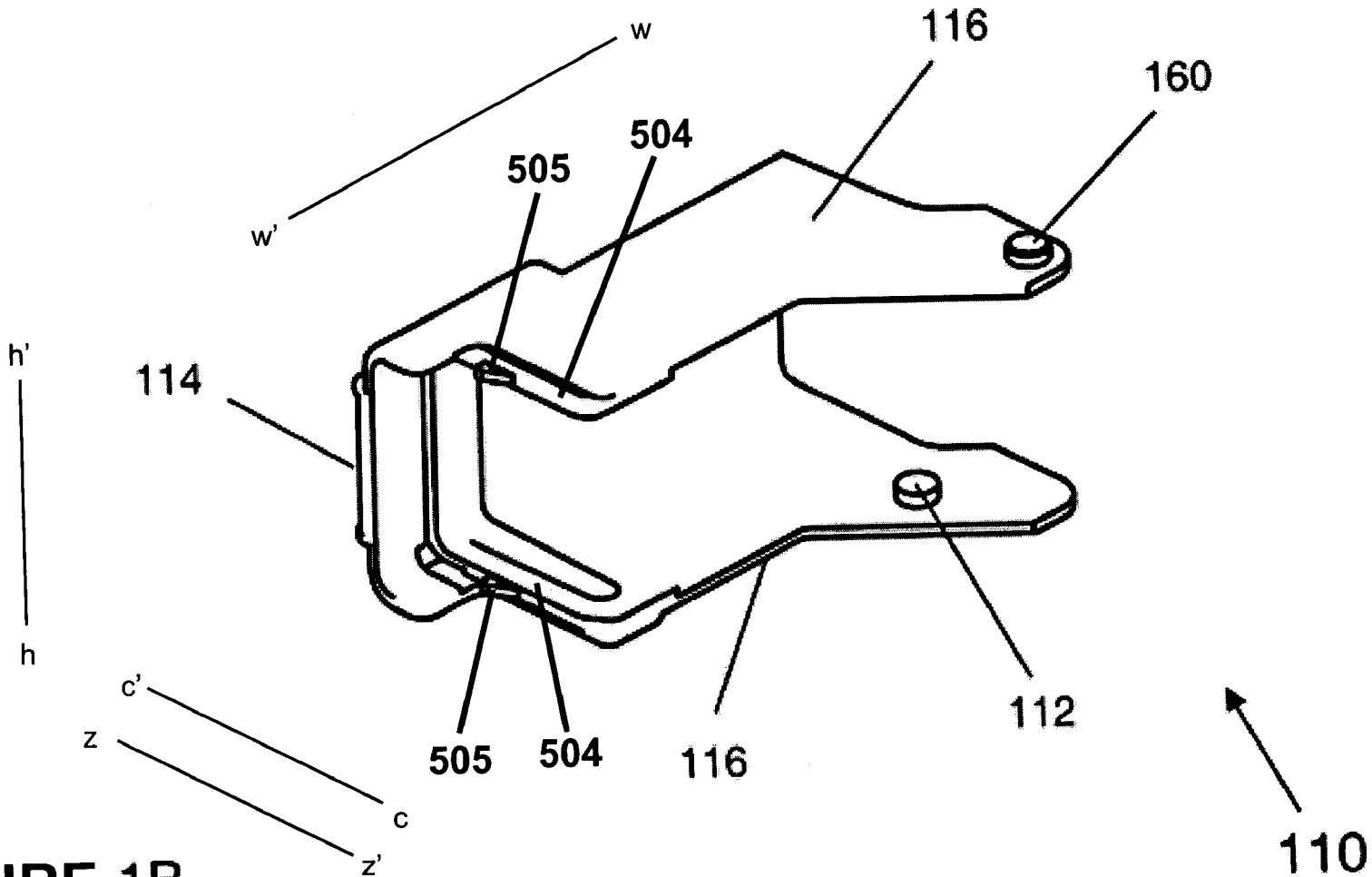
FIG. 1B is perspective view of the cover housing of the present invention.
Figure 1C:
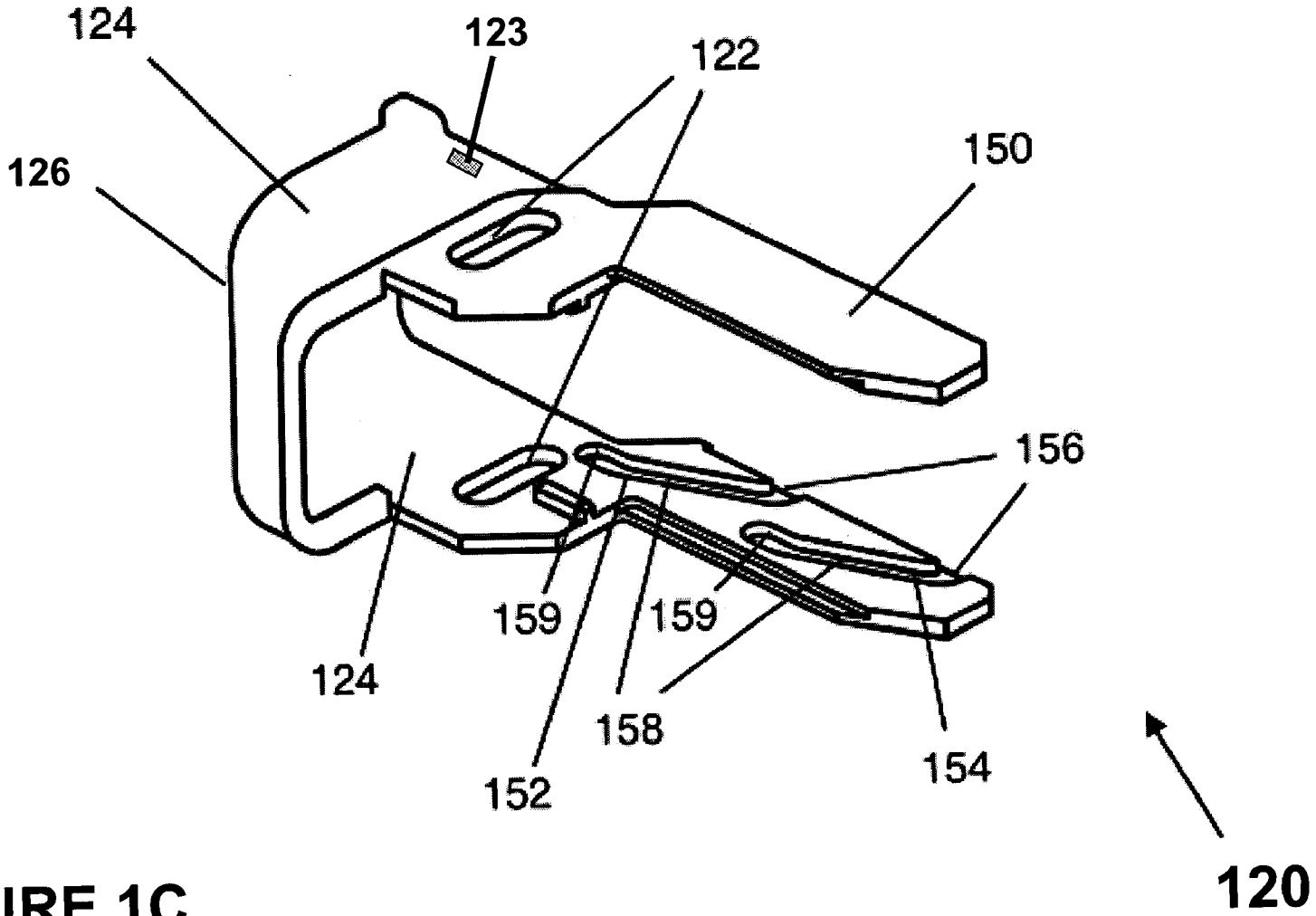
FIG. 1C is perspective view of the slide cam housing of the present invention.
Figure 1D:
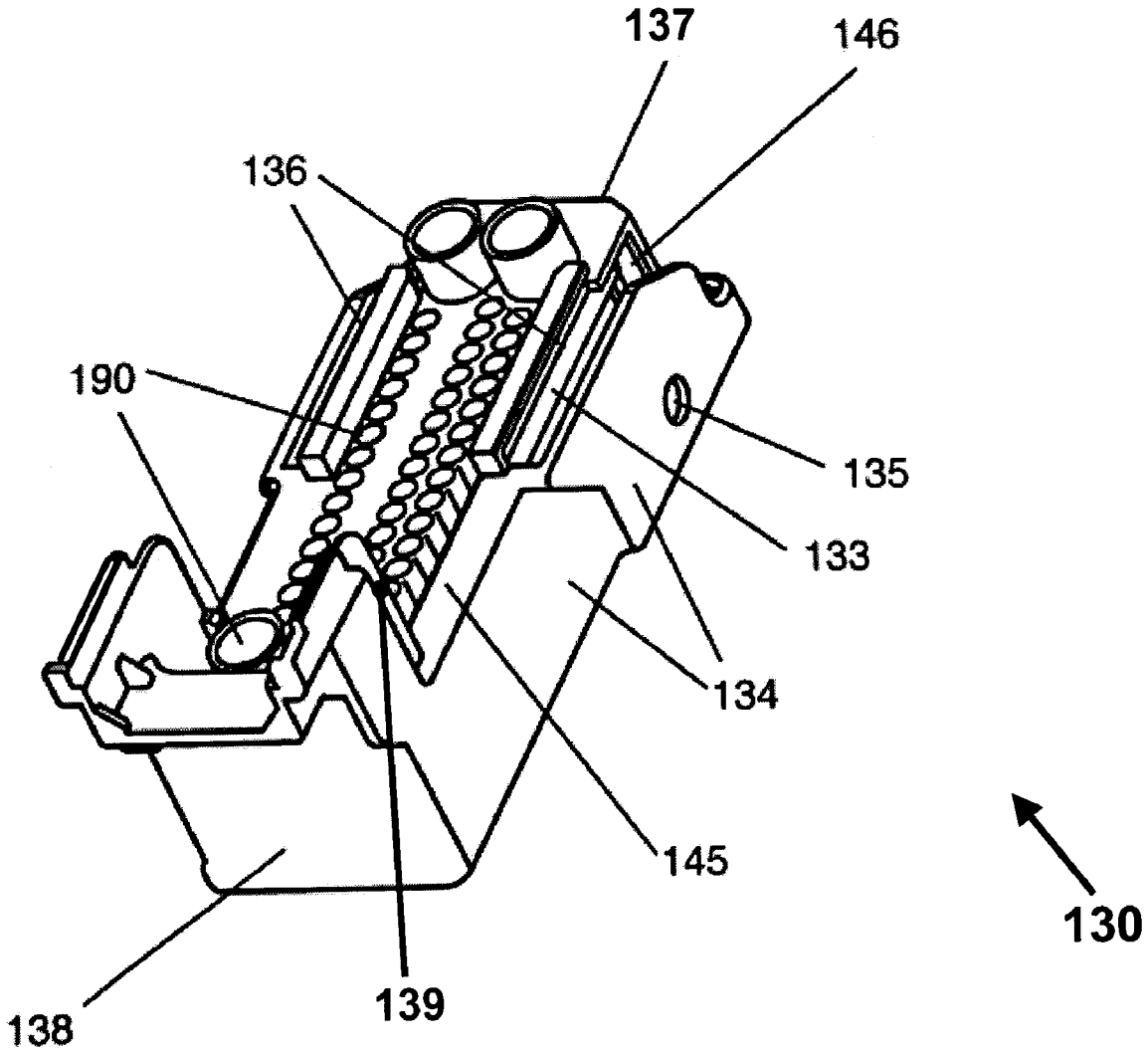
FIG. 1D is a perspective view of the base housing of the present invention.

With reference now to the details of FIGS. 1B–1E, each of the four components which make up the connector assembly 100 are separately illustrated. As noted above, the components include connector C and cover housing 110, slide cam housing 120, and base housing 130; the three combining to form housing H. As also mentioned hereinabove, the cover housing 110 forms a protective cover shielding the electrical connections made between the housing H and connector C as do the side walls 124 and the back wall 126 of slide cam housing 120. As shown in FIG. 1B, cover housing 110 is a three-sided housing having sidewalls 116 and a rear wall 114. The rear wall 114 and side walls 116 may optionally include ridges (not shown) which aid the user in engaging the cover housing 110 such that during operation of the cover housing 110, the finger or thumb of the user does not readily slip off the cover housing 110. Each of the sidewalls 116 includes one of the pivots 160 each being received in one of the pivot holes 135 of the base housing 130. Each of the sidewalls 116 further includes one of the projections 112 each being received in one of the projection guide tracks 122 of the slide cam housing 120.

Figure 5A:
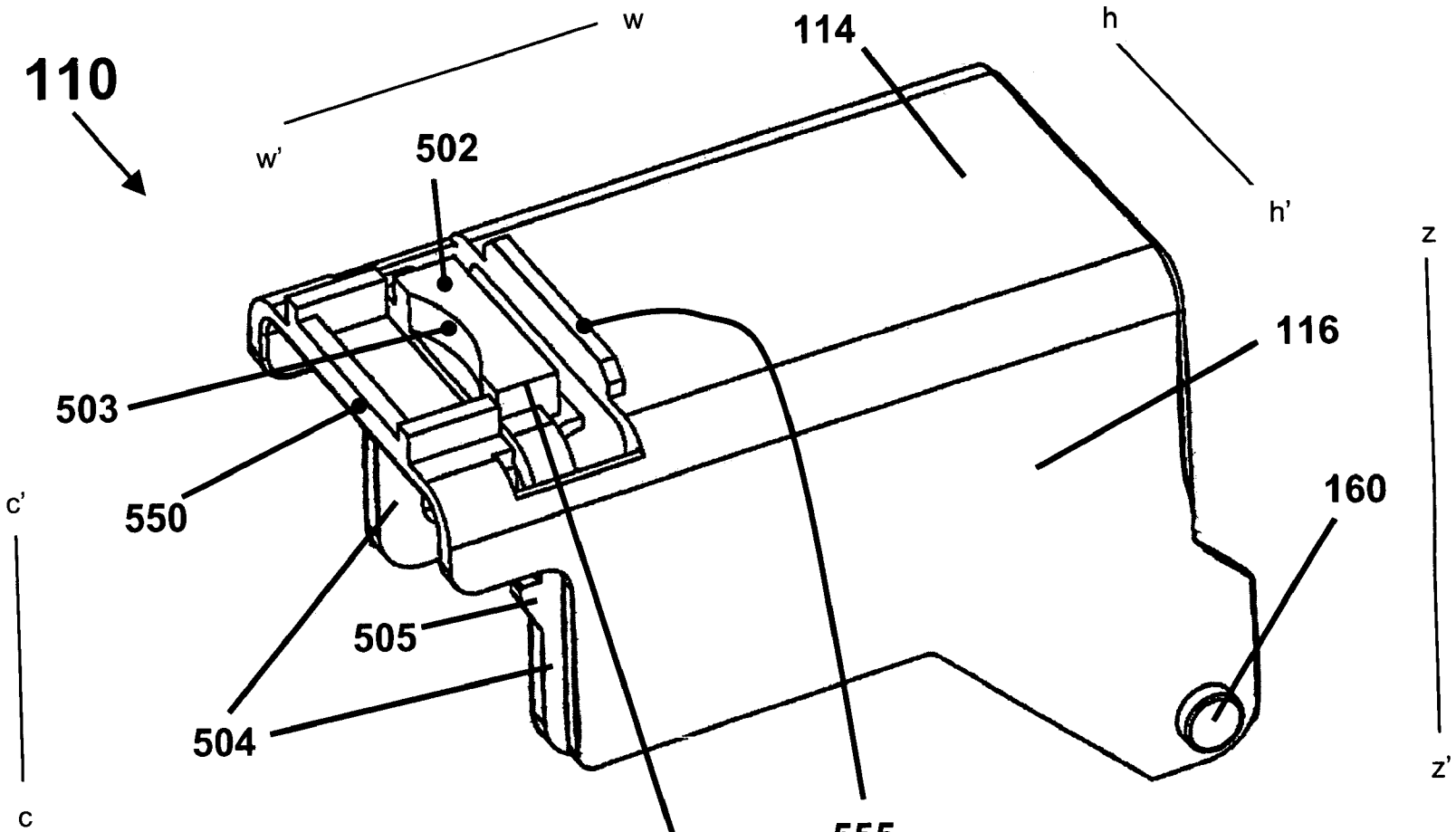
FIG. 5A is perspective view of the cover housing illustrating the lever lock of the present invention.

As shown in a perspective angle in FIG. 5A, rear wall 114 comprises the lever lock mechanism 501 of the present invention. The lever lock mechanism 501 is integrally molded with the cover housing 110. Reference is made to directions with respect to the axes illustrated in FIG. 5A and in FIG. 1B, where left and right refer to relative positions along the width axis, w'–w. Similarly, top and bottom refer to relative positions along the height axis, h'–h, and in and out refer to relative positions along the front-to-rear axis, z'–z.

Lever lock mechanism 501 at the left (w') end of the rear wall 114 has a release actuator 502 protruding slightly above the surface of rear wall 114 in the c' direction. The left-most face 503 of the release actuator 502 is slightly curved inward (toward w) to readily accept an operator's finger or other means of applying a release force. Release actuator 502 extends downward in the c direction substantially following the U-shaped contour of the cover housing 110 to form two opposing release legs 504. The release legs 504 may also be seen in cutaway FIG. 5B as they extend downward following the contour of cover housing 110. Each of the release legs 504 comprises a release latch 505 along the length of each release leg 504 along the c'–c axis. The release latches 505 are of sufficient width in the w–w' direction as to extend out and be received by corresponding release latch apertures 685 in base housing 130. Release latch apertures 685 are best illustrated in FIG. 6. When engaged, the release latch apertures 685 hold the release latches 505 to prevent the cover housing 110 from moving apart from the base housing 130, thereby ensuring a secure electrical connection.

Returning to FIG. 5B, release legs 504 extend along the c'–c axis to the bottom c of sidewalls 116 where they are attached to the side walls 116. Release legs 504 are formed in such a manner as to have a gap 506 between the rightmost portion 507 of the release leg 504 and the leftmost portion 508 of side wall 116. The gap 506 between rightmost portion 507 of the release leg 504 and the leftmost portion 508 of the side wall 116 provides an elastic response when a release force is applied to left-most face 503 of the release actuator 502. The release force retracts release latches 505 from release latch apertures 685 and allows cover housing 110 to move apart from base housing 130.

Figure 5B:
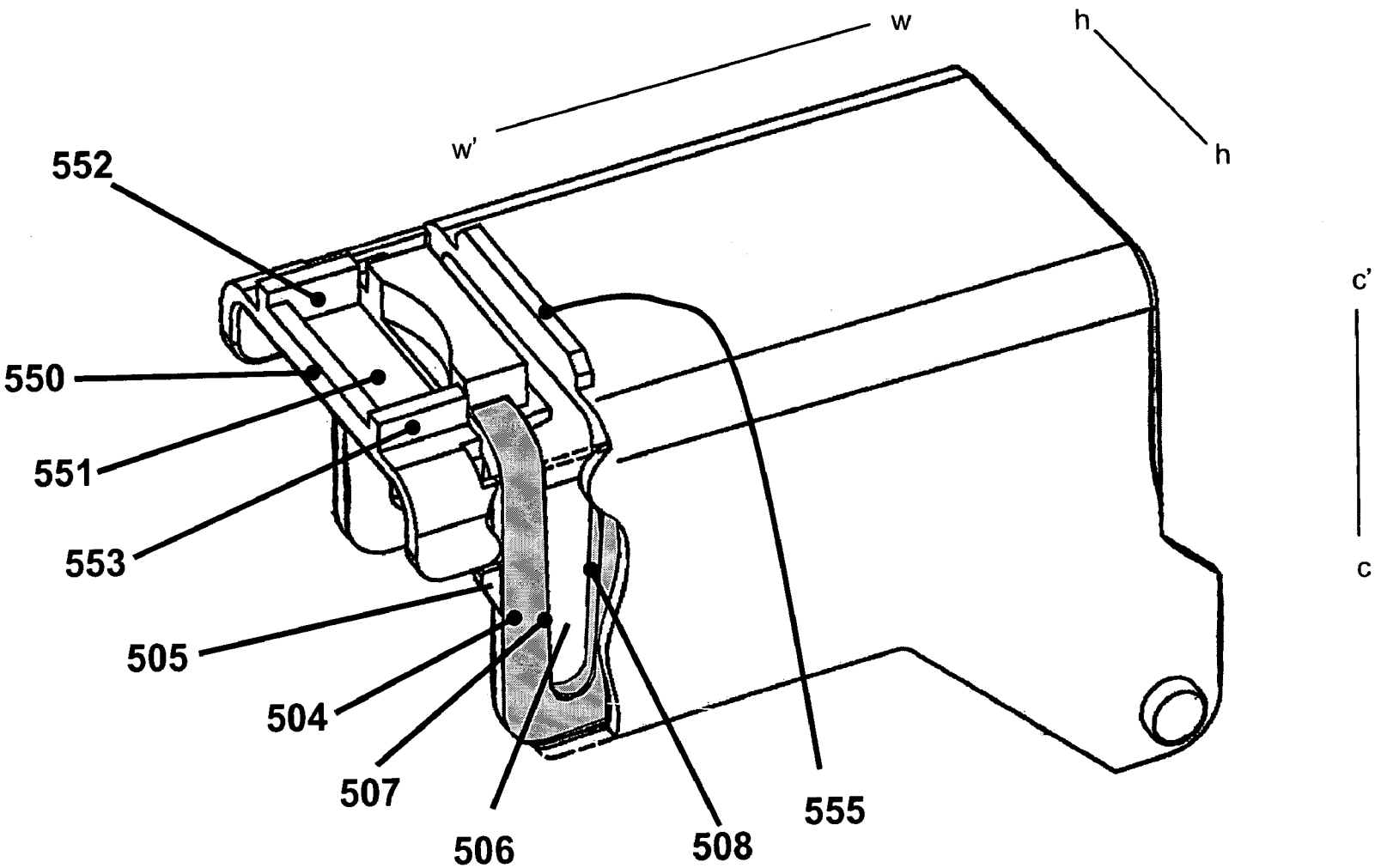
FIG. 5B is a cut-away view of the cover housing illustrating the lever lock of the present invention with a portion of the cover housing cut away to illustrate the internal workings of the lever lock.
Figure 6:
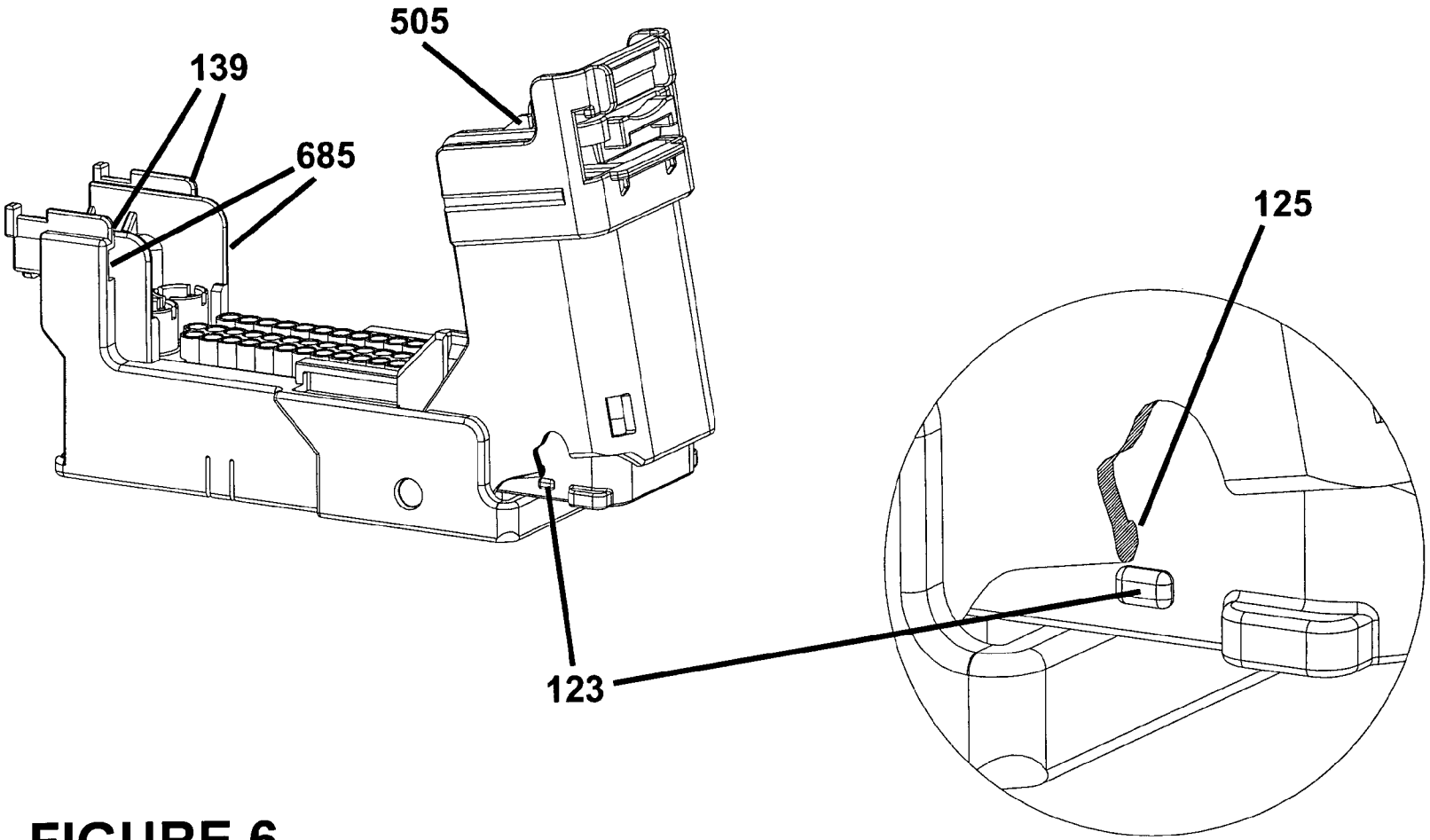
FIG. 6 is a perspective view of the connector housing just prior to being in a fully open position, just prior to engagement, illustrating the hold-open detent with an enlarged view of the hold-open detent.

As shown in FIG. 5B, left release actuator shield 550 and right release actuator shield 555 are integrally formed in rear wall 114 and protect release actuator 502 from inadvertent shock that might otherwise result in a release force applied to release actuator 502. Left release actuator 550 further comprises recessed section 551 between release actuator shield top-most barrier 552 and release actuator bottom-most barrier 553. In addition to forming the recessed area in which an operator may apply a release force to left-most face 503 of release actuator 502, barriers 552, 553 also provide additional protection from inadvertent shocks and forces that also might otherwise result in a release force applied to release actuator 502.

The release actuator 502 may be created from single direction molding, with no side-cores used in tooling release actuator 502. In this manner, release actuator 502 is an integral component of the U-shaped contour that characterizes cover housing 110.

As shown in FIG. 1C, slide cam housing 120 includes two side walls 124 and a back wall 126. The side walls 124 of the slide cam housing 120 are substantially planar with slide cam legs 150 extending from each of the side walls 124. The thickness of the sidewall 124 and of the slide cam legs 150 is such that both can be readily received by the base housing 130. As noted hereinabove, one side wall 124 includes first cam groove 152 and second cam groove 154 formed on an inside surface thereof while the opposing sidewall includes a corresponding second pair of cam grooves. The cam grooves 152 and 154 are identical images of one another and include lead-in portions 156, angled portions 158, and locking portions 159. The locking portions 159 may optionally include a detent portion at the end opposite the lead-in portion 156. The significance of the angled portions is explained in greater detail hereinbelow.

Additionally, slide cam housing 120 may include hold-open detents 123 that engage cover housing 110 when the housing H is in the fully-open position. Hold-open detents 123 are integrally formed in side walls 124 of slide cam housing 120 as illustrated in FIG. 1C and in the cut-away view of FIG. 6. Hold-open detents 123 rise above the surface of side walls 124 to form a small raised ridge. When housing H is fully-open, hold-open detents 123 engage hold-open detent apertures 125 in cover housing 110, as shown in FIG. 6, thereby preventing cover housing 110 from rotating when a slight rotation force is applied. When a greater rotation force is applied to cover housing 110 to rotate the cover housing 110 from a fully-open position toward a closed position, the greater initial force is used to overcome the restraining force provided by hold-open detents 123 when hold open detents are engaged in hold open detent apertures 125. Hold-open detents 123 provide a structure to maintain housing H in a fully-open position, where it may be populated with conductors or otherwise serviced.

Figure 5C:
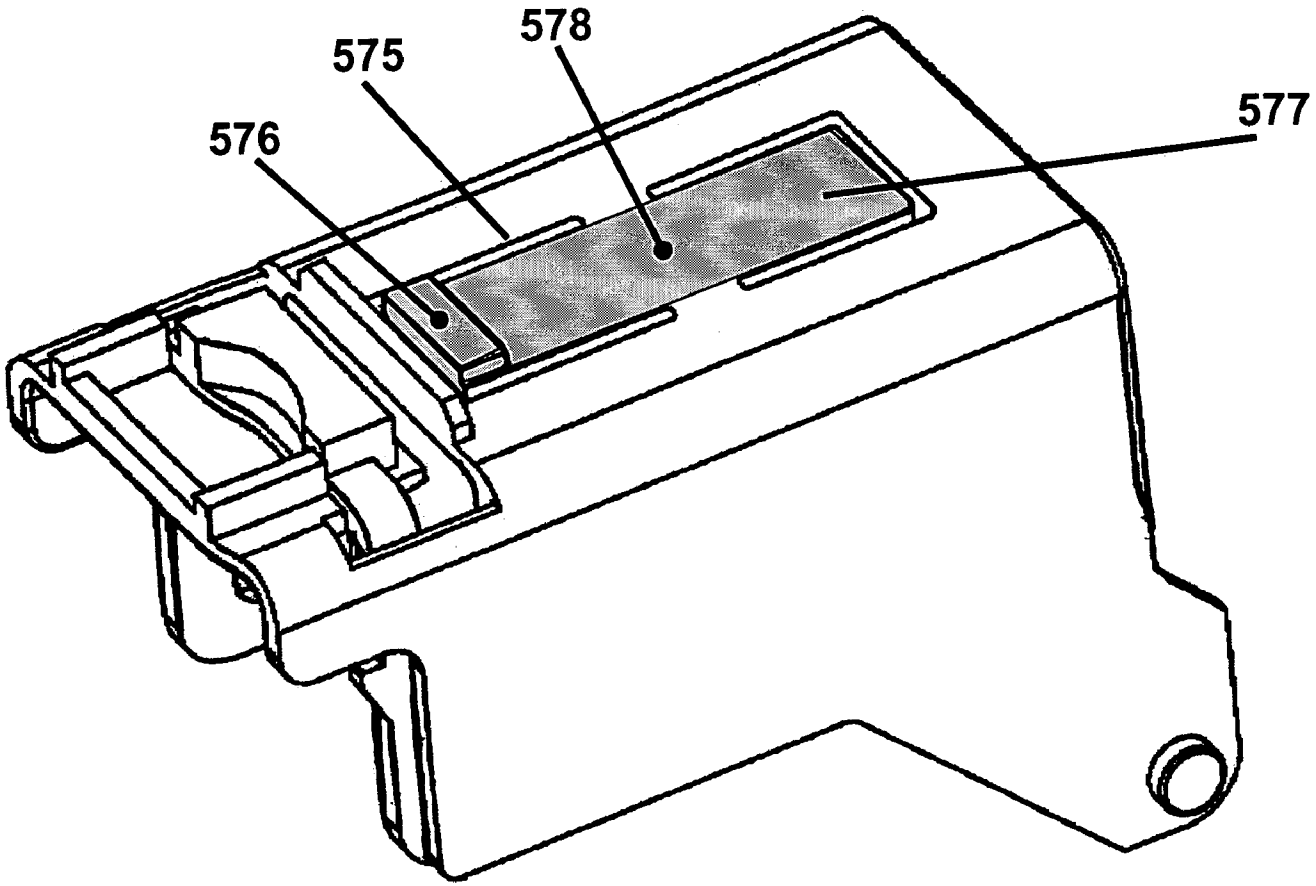
FIG. 5C is a perspective view of the cover housing illustrating the lever lock of the present invention with an optional secondary lock mechanism.

As shown in FIG. 5C, an optional hold-open lock mechanism 575 may be employed to secure the cover housing 110 to prevent the inadvertent closing of the housing H and connector C to secure the connector assembly 101. Hold-open lock mechanism 575 may be employed in place of, or in addition to, hold-open detents 123 to secure the cover housing 110 and to prevent inadvertent rotation of cover housing 110. Optional hold-open lock mechanism 575 comprises a lever assembly comprising a rigid bar 577 and a pivot 578. A release button 576 is located at the left-most portion of the rigid bar 577 of the optional hold-open lock mechanism 575. The point where the bar 577 rests on the pivot is the pivot point 578.

Figure 5D:
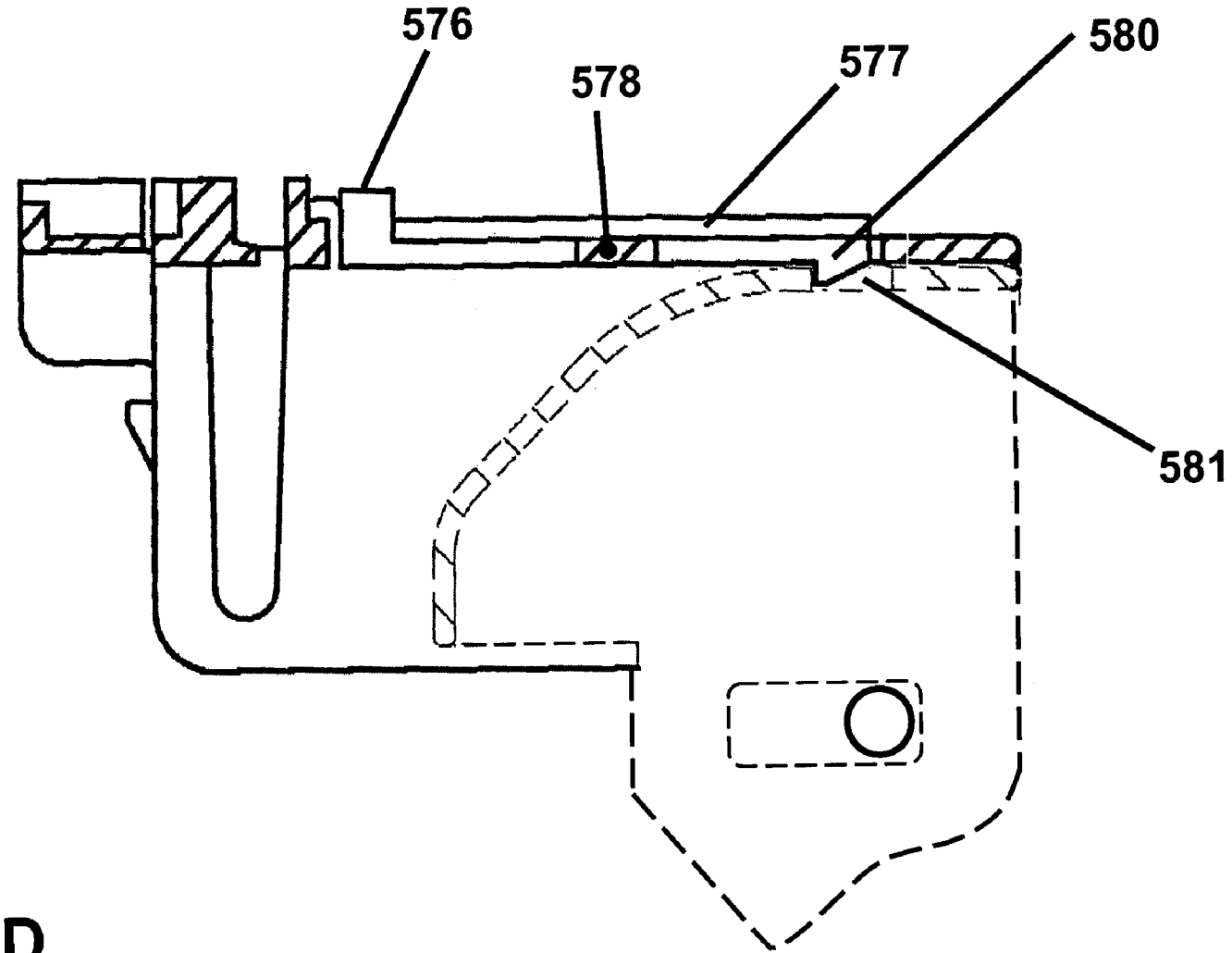
FIG. 5D is a side view of the cover housing illustrating the lever lock of the present invention with an optional secondary lock mechanism.

As shown in the cutaway view of cover housing 110 of FIG. 5D, at the right-most end of hold-open lock mechanism 575, a locking notch 580 on the underside of rigid bar 577 may be employed to further secure the cover housing 110 from accidentally closing. When the cover housing 110 is in a fully-open position, locking notch 580 engages a corresponding locking notch aperture 581 on the slide cam housing 120, and the cover housing 110 is secure. As a force is applied to the release button 576 of rigid bar 577, the rigid bar 577 pivots about pivot point 578, and the locking notch 580 is released from locking notch aperture 581 and the cover housing 110 is permitted to rotate toward a closed position.

As with any pivoting assembly, torque is the tendency of a force to rotate about an axis. The magnitude of the force applied to the optional hold-open lock mechanism 575 as well as the distance from the pivot point 578 (axis of rotation) at which this force is applied both affect the magnitude of the torque. The present invention contemplates many positions for the pivot point depending upon the torque necessary in the particular application. In any event, the force applied to release button 576 releases locking notch 580 from locking notch aperture 581. Additionally, anti-overstress protection features may also be incorporated to protect the locking mechanism.

FIG. 1D illustrates base housing 130. Base housing 130 includes guide channels 133 formed in each of the wing walls 134 on both sides of base housing 130. Guide channels 133 extend substantially parallel to and spaced from a respective sidewall 136 of the base housing 130. The configuration of the guide channels 133 includes an open section 146 and an enclosed section 145, the significance of which will be discussed in greater detail hereinbelow. The base housing 130 also includes end walls 137 and 138 with end wall 138 including a lead portion 139 for cooperating with the cover housing 110 in forming an opening to the housing H for receiving a lead wire, not shown.

An inner surface of each of the side walls 136 includes substantially parallel guide channels 133 for receiving the slide cam legs 150 of slide cam housing 120. Importantly, guide channels 133 accept slide cam legs 150 of slide cam housing 120 in both an open unmated position and in a closed mated position. The guide channels 133 are wider at the open sections 146 to accommodate the slide cam legs 150 of the slide cam housing 120 as well as the cover housing sidewalls 116 that extend to the pivots 160. The enclosed sections 145 of the guide channels 133 are narrower than the open sections 146 since only the slide cam legs 150 of the slide cam housing 120 are received in the enclosed section 145 of the guide channels 133. The guide channels 133 extend along the width of base housing 130 and aid in the proper alignment of the connector C with respect to the base housing 130.

Figure 1E:
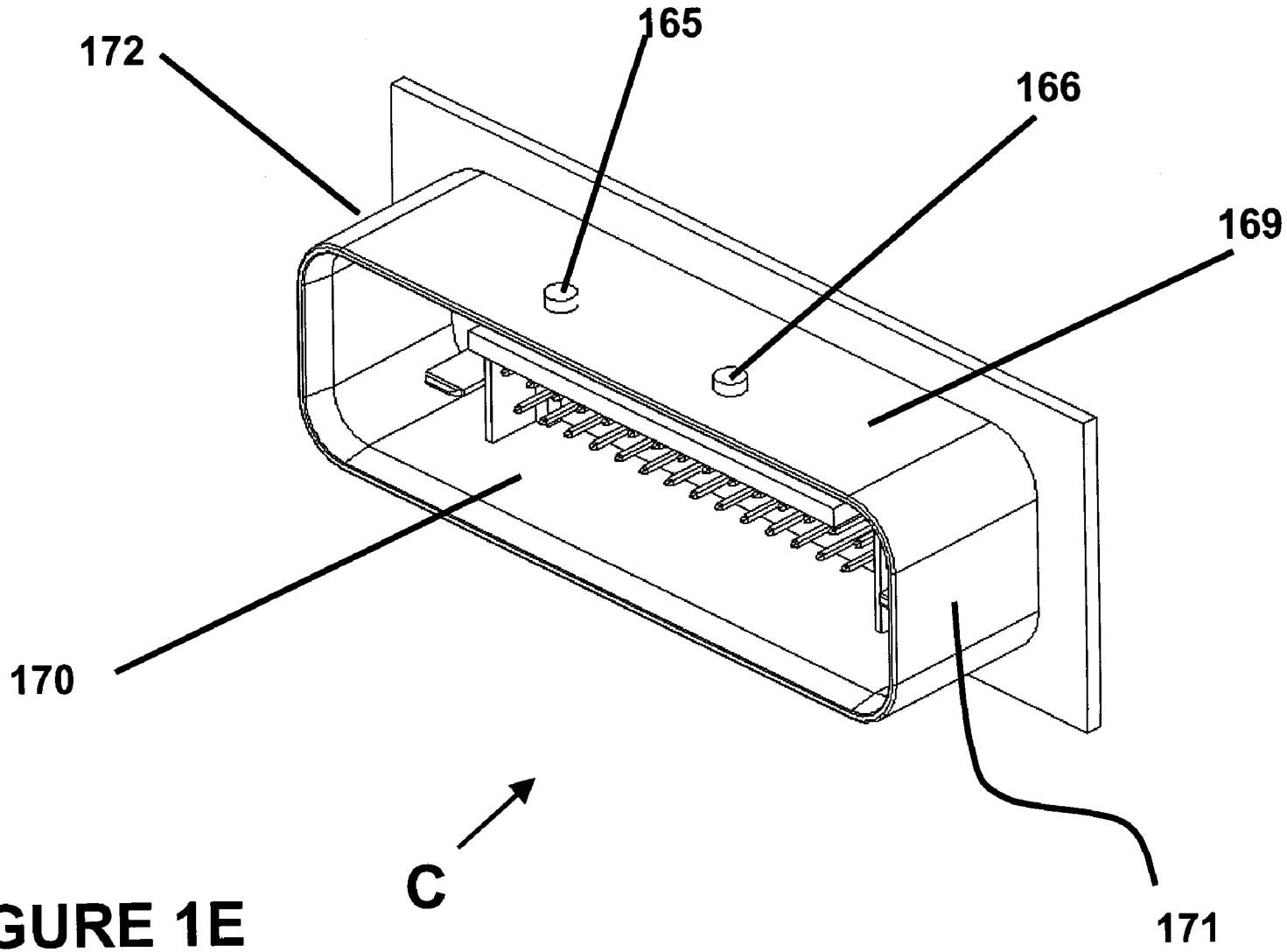
FIG. 1E is a perspective view of the connector of the present invention.
Figure 4A:
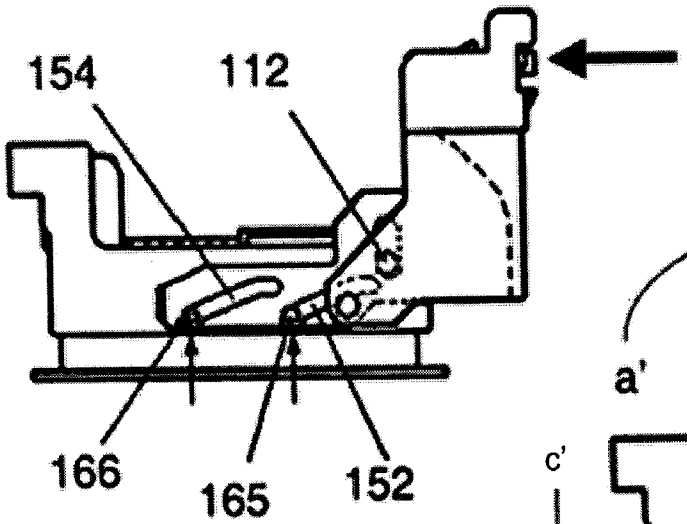
FIG. 4A is a front view of the connector assembly just prior to rotation of the cover housing.

FIG. 1E illustrates connector C. Connector C includes side walls 169 and 170 and end walls 171 and 172 with the projections 165 and 166 extending from a substantially center region of each of the side walls 169 and 170, the connector C being sized to be slidingly received within the base housing 130 as shown in FIG. 4A. The projections 165 and 166 extending outwardly a distance less than the thickness of side walls 136 of the base housing 130 so as to extend into the space formed between the sidewalls 136 and wing walls 134 of the base housing 130. This is so that the cam follower projections 165 and 166 can be received by the first and second cam grooves 152 and 154 of the slide, cam housing 120. This interaction will be described in greater detail hereinbelow.

Figure 2A:
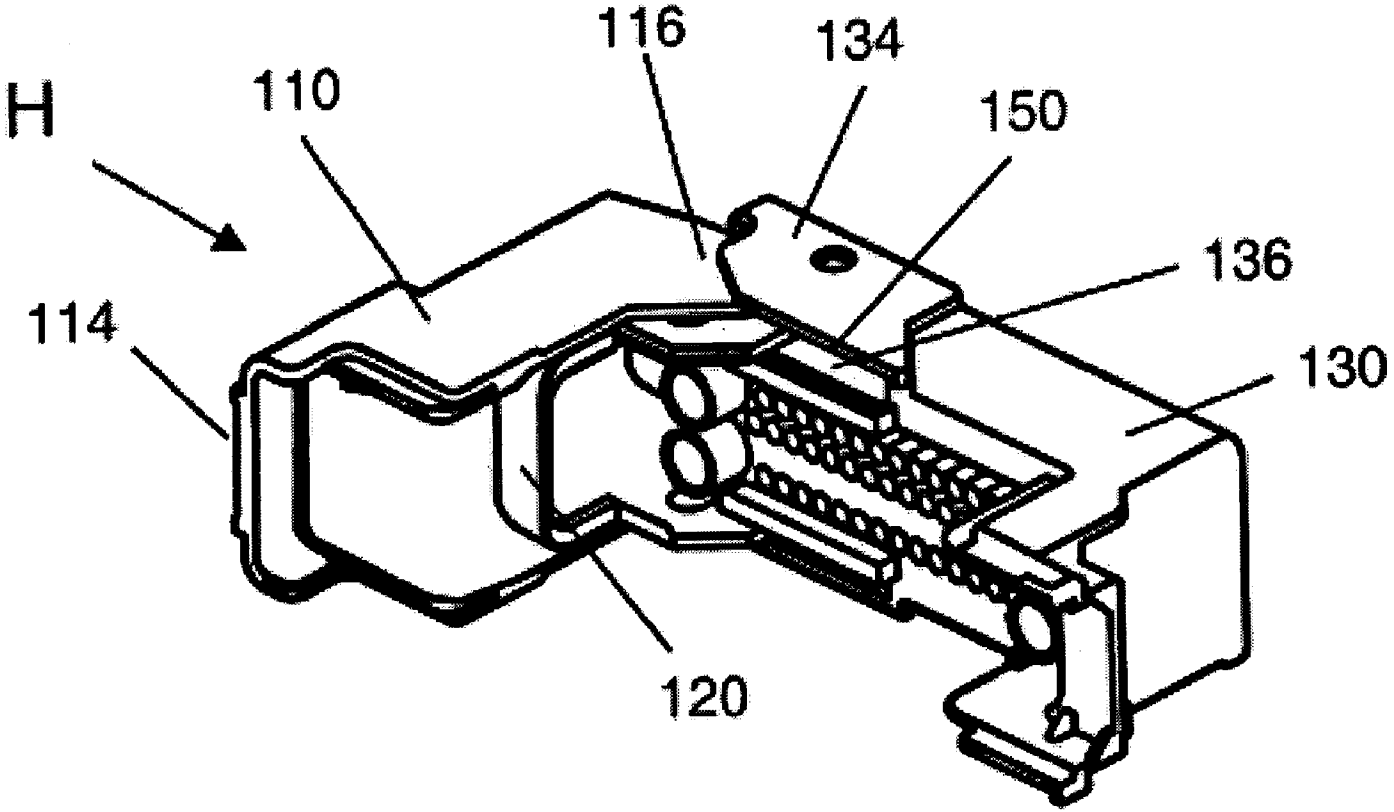
FIG. 2A is a perspective view of the connector housing in a fully open position just prior to beginning the mating process.

FIG. 2A illustrates connector assembly 100 in a fully unmated state. That is, connector C is not inserted in housing H. FIG. 2A shows housing H as it is activated to begin the mating process. For simplicity, and to better illustrate the operation of housing H, connector C is not shown in FIGS. 2A and 2B, but it should be understood that connector C is partially inserted in housing H prior to the method of practicing the present invention of mating the two structures of connector assembly 100. This arrangement is discussed below with respect to FIGS. 4A, 4B, and 4C.

Figure 2B:
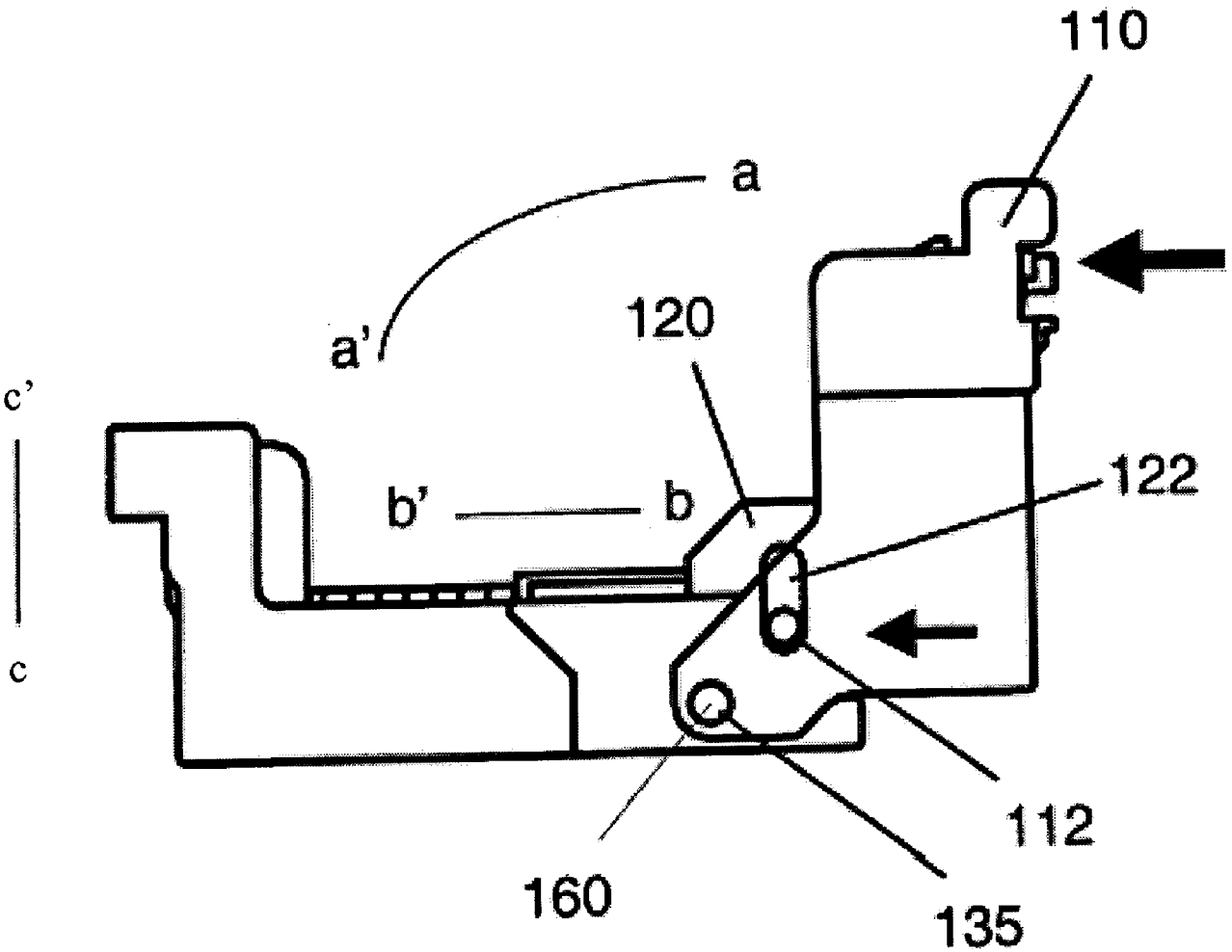
FIG. 2B is a front view of the connector housing showing the applied forces of the cover housing and the slide cam housing as the cover housing is rotated toward a mated state.

The initial operation of the present invention is further illustrated in FIGS. 2A and 2B. FIG. 2A illustrates the housing H in a fully open state, where the housing H is initially assembled, the slide cam housing 120 is received within the side walls 116 and in front of the rear wall 114 of cover housing 110 and further within the wing walls 134 of base housing 130. The pivots 160 of cover housing 110 are received in the pivot holes 135 of base housing 130, and the side walls 124 of slide cam housing 120 are received in the space formed between the wing walls 134 and the sidewalls 136 of base housing 130 which makes up guide channels 133. Further, the respective slide cam legs 150 of the slide cam housing 120 are received in the corresponding guide channels 133 formed in the wing walls 134 of base housing 130. The cover housing 110 and the base housing 130 are hingedly connected to one another such that the pivots 160 of cover housing 110 are securely disposed in pivot holes 135 of base housing 130. As best illustrated in FIG. 2A, slide cam legs 150 of slide cam housing 120 are sandwiched between base housing side walls 136 and cover housing sidewalls 116. Base housing wing walls 134 further form the outermost wall of housing H.

FIG. 2B shows housing H as cover housing 110 fully-opened to begin the mating process. Cover housing 110 is pivotally mounted on base housing 130 utilizing pivots 160 in cover housing 110 and pivot holes 135 in base housing 130. Slide cam legs 150 of slide cam housing 120 are interposed adjacent to side walls 116 of cover housing 110. Both the slide cam legs 150 and the side walls 116 of cover housing 110 are sandwiched between the side walls 136 of base housing 130 and wing walls 134 of base housing 130.

Cover housing 110 is set to its fully-open state in the base housing 130 and will rotate along directional arc a–a' during mating. As cover housing 110 is rotated, projections 112 exert pressure on projection guide tracks 122 with force components generally in the width direction of the housing and in the front-to-rear direction of the housing H. The width direction is shown in FIG. 2B as directional line b–b' and the front-to-rear direction is shown in FIG. 2B as directional line c'–c. The corresponding force arrows in the appropriate directions are also shown.

Figure 8B:
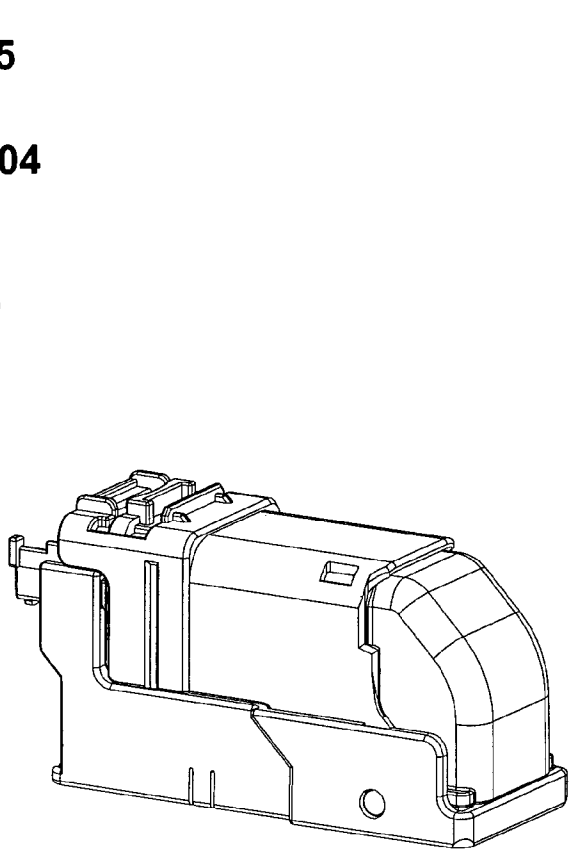
FIG. 8B is a perspective view of the connector assembly in a fully closed (mated) position.
Figure 8A:
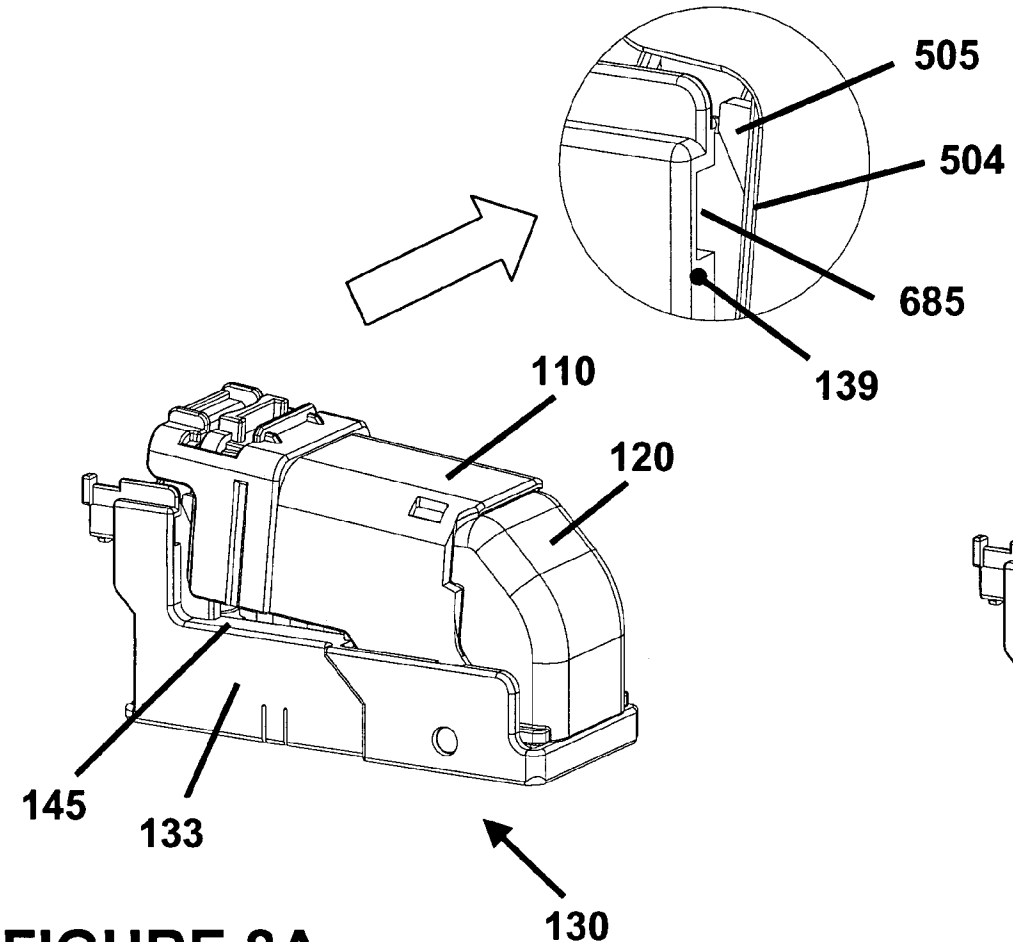
FIG. 8A is a perspective view of the connector assembly just prior to reaching a fully-closed (mated) position with an enlarged view of the release latch entering the release latch aperture.

The pressure exerted by projection 112 on projection guide tracks 122 causes slide cam housing 120 to move linearly in the width direction along line b–b'. As cover housing 110 is rotated to a fully closed mated position, projection 112 continues to force slide cam housing 120 to move linearly along direction line b–b' until release latches 505 on cover housing 110 encounter the lead portion 139 of housing connector 130 just above release latch apertures 685. This effect is best illustrated in FIG. 8A. The position of release latches 505 on cover housing 110 is such that when rotating cover housing 110 toward a closed position, release latches 505 touch housing connector 130 just prior to engaging release latch apertures 685. The transition between the surface of lead portion 139 of housing connector 130 and release aperture 685 allows sidewalls 116 to meet a mechanical stop, which are the enclosed sections 139 around latch aperture 685 of base housing 130. Cover housing 110 encounters these mechanical stops corresponding to the end of the full range of angular motion of cover housing 110 and an audible sound may be heard indicating the connector has been locked properly. Cover housing 110 and lead portion 139 of base housing 130 meet to form a protective cover, as will slide cam housing 120, for cable and wires leading to chambers 190 of base housing 130. As shown in FIG. 8B, at this point, cover housing 110 is in its fully closed position corresponding to the end of travel along arc a–a', and slide cam housing 120 is at the end of linear travel along direction line b–b'.

Figure 3:
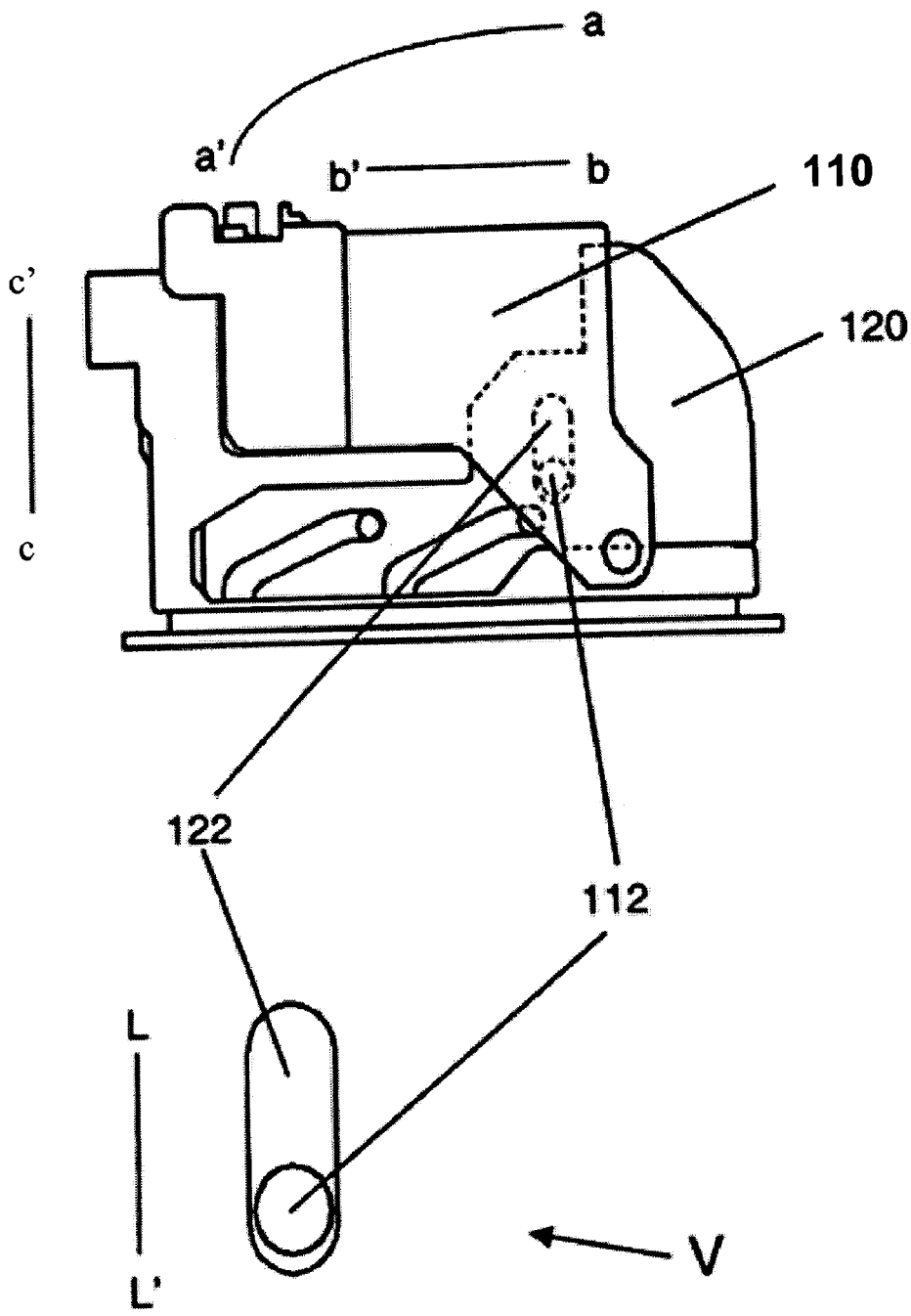
FIG. 3 is a front view of the connector housing showing the cover housing in a fully closed position with an enlarged view of the projection.

Referring now to FIG. 3, once cover housing 110 has been rotated to its fully closed position, projection 112 has traveled in substantially the same parallel to arc a–a'. During this range of motion, projection 112 continued to force slide cam housing 120 to travel in a linear direction as projection 112 exerted pressure on projection guide tracks 122. Once cover housing 110 reaches the end of travel along arc a–a', slide cam housing 120 has traveled the full range of linear motion along direction line b–b' as well.

An enlargement of projection 150 in this position is shown in expanded view V of FIG. 3. The shape of projection 112 is substantially a circle, while the shape of projection guide tracks 122 is substantially a rounded rectangle. The length of the projection guide tracks 122 L–L' is longer than the diameter of projection 112. As such, projection 112 is able to move within the bounds of the walls of projection guide tracks 122 as cover housing 110 is rotated along arc a–a' from an open unmated position to a closed mated position. With projection 112 enjoying freedom to move within the projection guide tracks 122, the mating force in the c–c' direction peaks as cover housing 110 is closed along arc a–a' as slide cam housing 120 moves linearly in the b–b' direction.

Figure 4B:
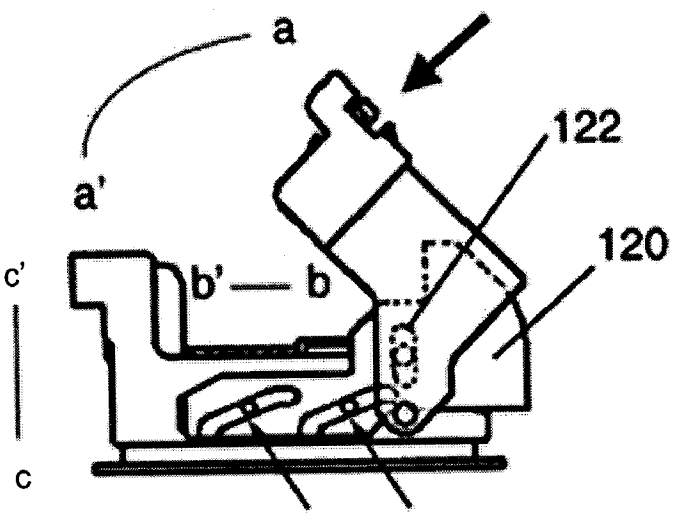
FIG. 4B is a front view depicting the connector assembly as the cover housing is in the process of being rotated.
Figure 4C:
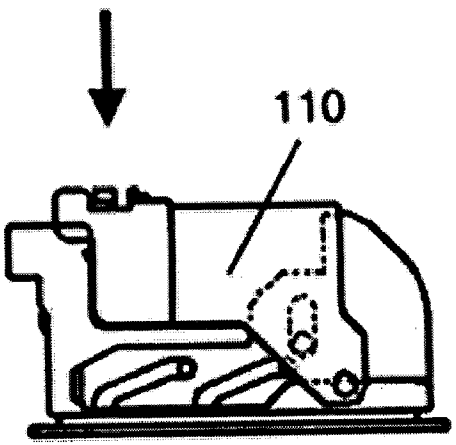
FIG. 4C is a front view showing the cover housing fully rotated and the connector assembly in its fully mated state.

Referring now to FIGS. 4A, 4B, and 4C, at the same time cover housing 110 is rotated and projection 112 forces slide cam housing 120 to move linearly in the b–b' direction by exerting pressure on projection guide tracks 122, first cam groove 152 on slide cam housing 120 engages first cam follower projections 165 on connector C and second cam groove 154 engages second cam follower projections 166 on connector C. In the illustrated embodiment shown in detail in FIG. 1C, first cam groove 152 and second cam groove 154 are angled with lead-in portions 156 to accept first cam follower projections 165 and second cam follower projections 166. First cam groove 152 and second cam groove 154 also have angled portions 158. In the illustrated embodiment in FIG. 4B, a force in the c–c' mating direction is provided as cover housing 110 is rotated.

As cover housing 110 is rotated, slide cam housing 120 moves linearly along b–b'. As slide cam housing 120 moves linearly, first cam grooves 152 engage first cam follower projections 165, and second cam grooves 154 engage second cam follower projections 166. This action drives first cam follower projection 165 and second cam follower projections 166 in the c–c' direction. The projections 112 move freely in projection guide tracks 122 permit a substantially constant mating force to be applied in the c–c' direction. Coupled with the angular camming action of the cam grooves, connector C and housing H are drawn together into a mated condition by exerting a substantially constant force in the c–c' direction. This substantially constant force, along with the cam grooves 152, 154 and cam follower projections 165, 166 facilitates proper alignment of connector C and housing H as the structures are mated. Other, non-floating projection and projection guide track geometries may result in differential forces, which are much more likely to skew the connector C or the housing H and result in a faulty connection or a damaged connector assembly. While the floating projection-projection guide track assembly provides substantially constant force in the c–c' mating direction, the mating force is optimized with the largest c–c' force component when projections 112 are components of cover housing 110 and projection guide tracks 122 are components of slide cam housing 120. Reversing these components will result in a proper constant force application, but the magnitude of the c–c' directional component may be compromised.

The rotational motion of the cover housing 110 causes linear motion of slide cam housing 120 and a resulting linear motion of the pairs of cam grooves 152, 154 engaging the cam follower projections 165, 166, thereby causing linear motion of connector C relative to housing H along the c–c' direction, resulting in a mated connector assembly.

In FIGS. 4A, 4B, and 4C, the housing H is shown in three positions as the cover housing 110 is rotated. In FIG. 4A, cover housing projection 112 is at its initial unmated position. Since cover housing 110 has not been rotated, cover housing projection 112 has not applied force to projection guide tracks 122, and thereby slide cam housing 120 has not yet moved linearly, nor have the cam grooves 152, 154 of slide cam housing 120 engaged the cam follower projections 165, 166. In FIG. 4B, cover housing 110 is in the process of being rotated along arc a–a', thereby forcing projection 112 to drive slide cam housing 120 in the b–b' direction by applying pressure on projection guide tracks 122. As cover housing 110 is rotated toward its closed mated position, projection 112 drives slide cam housing 120 in the b–b' direction. Also, first cam grooves 152 receive and engage first cam follower projections 165 and the second cam grooves 154 receive and engage second cam follower projections 166 on connector C. During this point, the angled portions 158 of cam grooves 152 and 154 are engaging cam follower projections 165 and 166 providing a force reduction.

As discussed hereinabove, as cover housing 110 is rotated to a fully closed mated position, projection 112 continues to force slide cam housing 120 to move linearly along direction line b–b' until release latches 505 on cover housing 110 encounter the lead portion 139 of housing connector 130 just above release latch apertures 685. This effect is best illustrated in FIG. 8A. The position of release latches 505 on cover housing 110 is such that when rotating cover housing 110 toward a closed position, release latches 505 touch housing connector 130 just prior to engaging release latch apertures 685. The transition between the surface of lead portion 139 of housing connector 130 and release aperture 685 allows sidewalls 116 to meet a mechanical stop, which are the enclosed sections 139 around latch aperture 685 of base housing 130. Cover housing 110 encounters these mechanical stops corresponding to the end of the full range of angular motion of cover housing 110 and an audible sound may be heard indicating the connector has been locked properly. Cover housing 110 and lead portion 139 of base housing 130 meet to form a protective cover, as will slide cam housing 120, for cable and wires leading to chambers 190 of base housing 130. As shown in FIG. 8B, at this point, cover housing 110 is in its fully closed position corresponding to the end of travel along arc a–a', and slide cam housing 120 is at the end of linear travel along direction line b–b'.

As shown in FIG. 4C, cover housing 110 is fully rotated, and the connection is complete. As discussed above with relation to FIG. 8B, when cover housing 110 is fully rotated, projection 112 has fully driven slide cam housing 120 to its full length of linear travel in the b–b' direction. An audible click, tactile feedback, or other sensory indication may alert a user that a connection has been completed.

Figure 7:
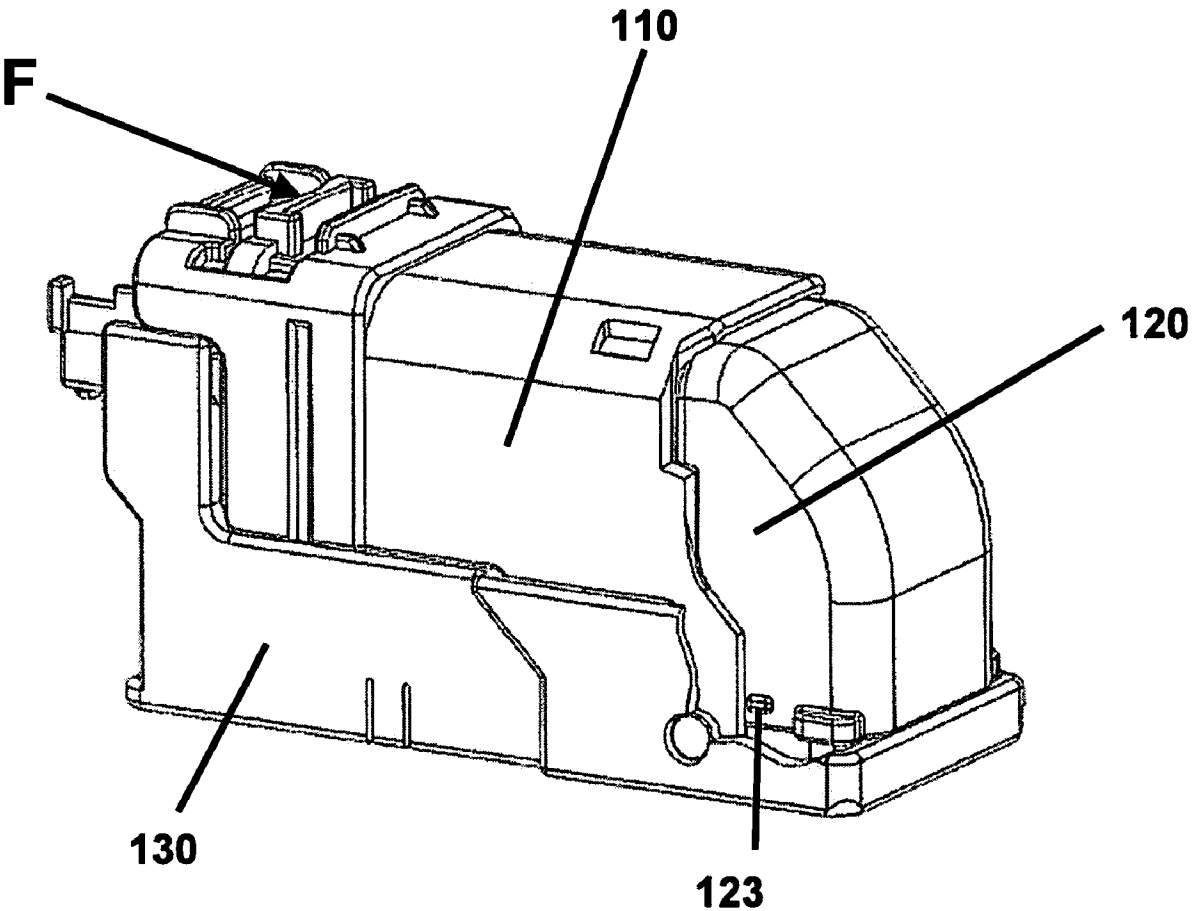
FIG. 7 is a perspective view of the connector housing showing the cover housing in a fully-closed position.

If an operator must un-mate the connector assembly, the operator applies a release force F to the left-most face 503 of release actuator 502. The direction of release force F is shown in FIG. 7. The release force F causes the release legs 504 of lever lock mechanism 501 to deform in the w direction, thereby causing release latches 505 to disengage from release latch apertures 685.

Once release latches 505 are disengaged from release latch apertures 685, an operator may rotate cover housing 110 toward its initial position along arc a'–a. This, in turn, drives projection 112 against projection guide tracks 122 and forces slide cam housing 120 to move linearly in the opposite direction along b'–b. Simultaneously, as cover housing 110 is further rotated, the rotation forces first cam follower projections 165 and second cam follower projections 166 back along first cam groove 152 and second cam groove 154, respectively with force components generally in the width direction b'–b of the housing and in the front-to-rear direction c'–c of the housing H. For reference, the width direction b–b' and the front-to-rear direction, c'–c are shown in FIG. 4B. This disengaging of the cam followers from the cam grooves allows connector C to withdraw from housing H. When cover housing 110 is rotated back to its starting position, projection 112 has driven cam slide housing 120 back to its initial position as well. At this point, cover housing 110 is once again in its fully open position and projection 112 and slide cam housing 120 have been returned to their initial ends of travel.

While the present invention have been described in connection with a number of exemplary embodiments and implementations, the present invention is not so limited but rather covers various modifications and equivalent arrangements, which fall within the purview of the appended claims.

What is claimed is:

1. A lever-type electrical connector that reduces required connecting mating forces comprising:

a base housing including a guide channel;

a cover housing pivotally mounted on the base housing, the cover housing comprising a cover housing projection and further comprising arms pivoted on opposite sides of the base housing on a common axis and an operating member linking the arms for arcuate movement of the cover housing, the operating member and the base housing each having a latch member, the latch members being releasably engageable with each other to hold the operating member at one extreme end of the arcuate movement; and a slide cam housing mounted on the base housing and including a projection guide track for receiving the cover housing projection, the slide cam housing extending into the guide channel of the base housing, wherein the base housing prevents flexing of the cover housing thereby preventing flexing of the cover housing in a manner that would cause inadvertent release of the latch members when the lever is in a secured state; and wherein the guide channel includes an arcuate stop to prevent further travel of the cover housing.

2. The lever-type electrical connector of claim 1, wherein the slide cam housing further comprises at least one cam groove to engage an opposite sex connector assembly.

3. The lever-type electrical connector of claim 1, wherein the assembly is sealed to prevent liquid and vapor penetration.

4. The lever-type electrical connector of claim 1, wherein the slide cam housing further comprises a hold-open detent.

5. The lever-type electrical connector of claim 4, wherein the cover housing further comprises a hold-open detent receiving portion to engage in the hold-open detent of the slide cam housing to maintain the connector in a fully open position.

6. The lever-type electrical connector of claim 1 wherein the slide cam housing includes two opposing slide cam legs and the base housing includes two opposing guide channels such that a respective slide cam leg is received in a respective guide channel.

7. The lever-type electrical connector of claim 6 wherein there are at least two cam grooves formed in each of the slide cam legs of the slide cam, and the slide cam is a single-piece component.

8. The lever-type electrical connector of claim 7, wherein the slide cam housing includes a back wall that protects chambers, terminals, and wires when the cover housing is rotated to a mated position.

9. The lever-type electrical connector of claim 8, wherein the connector is sealed to prevent liquid and vapor penetration.

10. The lever-type electrical connector of claim 1, wherein the cover housing latch member is integrally formed within the operating member of the cover housing.

11. The lever-type electrical connector of claim 10, wherein the cover housing latch member is fully protected and concealed within the profile of the cover housing.

12. The lever-type electrical connector of claim 11, wherein the slide cam housing further comprises a hold-open detent.

13. The lever-type electrical connector of claim 12, wherein the cover housing further comprises a hold-open detent receiving portion to engage in the hold-open detent of the slide cam housing to maintain the connector in a fully open position.

14. A lever-type electrical connector assembly that reduces required connecting mating forces comprising:

a first connector comprising a cam follower projection;

a base housing including a guide channel;

a cover housing pivotally mounted on the base housing, the cover housing comprising a cover housing projection and further comprising arms pivoted on opposite sides of the base housing on a common axis and an operating member linking the arms for arcuate movement of the cover housing, the operating member and the base housing each having a latch member, the latch members being releasably engageable with each other to hold the operating member at one extreme end of the arcuate movement; and a slide cam housing mounted on the base housing and including a projection guide track for receiving the cover housing projection, the slide cam housing extending into the guide channel of the base housing, wherein the base housing prevents flexing of the cover housing thereby preventing flexing of the cover housing in a manner that would cause inadvertent release of the latch members when the lever is in a secured state; and wherein the base housing guide channel includes an arcuate stop to prevent further travel of the cover housing.

15. The lever-type electrical connector assembly of claim 14, wherein the assembly is sealed to prevent liquid and vapor penetration.

16. The lever-type electrical connector assembly of claim 14, wherein the slide cam housing further comprises a hold-open detent.

17. The lever-type electrical connector assembly of claim 16, wherein the cover housing further comprises a hold-open detent receiving portion to engage in the hold-open detent of the slide cam housing to maintain the connector in a fully open position.

18. The lever-type electrical connector assembly of claim 14 wherein the slide cam housing includes two opposing slide cam legs and the base housing includes two opposing guide channels such that a respective slide cam leg is received in a respective guide channel.

19. The lever-type electrical connector assembly of claim 18 wherein there are at least two cam grooves formed in each of the slide cam legs of the slide cam, and the slide cam is a single-piece component.

20. The lever-type electrical connector assembly of claim 19, wherein the slide cam housing includes a back wall that protects chambers, terminals, and wires when the cover housing is rotated to a mated position.

21. The lever-type electrical connector assembly of claim 20, wherein the connector is sealed to prevent liquid and vapor penetration.

22. The lever-type electrical connector assembly of claim 14, wherein the cover housing latch member is integrally formed within the operating member of the cover housing.

23. The lever-type electrical connector of claim 22, wherein the cover housing latch member is fully protected and concealed within the profile of the cover housing.

24. The lever-type electrical connector assembly of claim 23, wherein the slide cam housing further comprises a hold-open detent.

25. The lever-type electrical connector assembly of claim 24, wherein the cover housing further comprises a hold-open detent receiving portion to engage in the hold-open detent of the slide cam housing to maintain the connector in a fully open position.

26. A lever-type electrical connector assembly that reduces required connecting mating forces comprising:

a first connector comprising a cam follower projection;

a base housing comprising a guide channel and a latch member;

a cover housing pivotally mounted on the base housing for arcuate movement of the cover housing, the cover housing comprising a cover housing projection and an operating member; and a slide cam housing mounted on the base housing comprising a projection guide track for receiving the cover housing projection a cam groove to engage the cam follower projection of the first connector, wherein the operating member comprises a latch member releasably engageable with the base housing latch member to hold the operating member at one extreme end of the arcuate movement; and wherein the base housing guide channel includes an arcuate stop to prevent further travel of the cover housing.

27. The lever-type electrical connector assembly of claim 26, wherein the guide channel includes an arcuate stop to prevent further travel of the cover housing.

28. The lever-type electrical connector assembly of claim 26, wherein the assembly is sealed to prevent liquid and vapor penetration.

29. The lever-type electrical connector assembly of claim 26, wherein the slide cam housing further comprises a hold-open detent.

30. The lever-type electrical connector assembly of claim 29, wherein the cover housing further comprises a hold-open detent receiving portion to engage in the hold-open detent of the slide cam housing to maintain the connector assembly in a fully open position.

31. The lever-type electrical connector assembly of claim 26 wherein the slide cam housing includes two opposing slide cam legs and the base housing includes two opposing guide channels such that a respective slide cam leg is received in a respective guide channel.

32. The lever-type electrical connector assembly of claim 31 wherein there are at least two cam grooves formed in each of the slide cam legs of the slide cam, and the slide cam is a single-piece component.

33. The lever-type electrical connector assembly of claim 32, wherein the slide cam housing includes a back wall that protects chambers, terminals, and wires when the cover housing is rotated to a mated position.

34. The lever-type electrical connector assembly of claim 33, wherein the connector is sealed to prevent liquid and vapor penetration.

35. The lever-type electrical connector assembly of claim 26, wherein the cover housing latch member is integrally formed within the operating member of the cover housing.

36. The lever-type electrical connector of claim 35, wherein the cover housing latch member is fully protected and concealed within the profile of the cover housing.

37. The lever-type electrical connector assembly of claim 36, wherein the slide cam housing further comprises a hold-open detent.

38. The lever-type electrical connector assembly of claim 37, wherein the cover housing further comprises a hold-open detent receiving portion to engage in the hold-open detent of the slide cam housing to maintain the connector assembly in a fully open position.

39. A method of locking a connection member into secure electrical engagement with a housing member, said method comprising:

inserting the connection member into the housing member, the connection member comprising a first cam follower projection and a second cam follower projection, and the housing member comprising:

a base housing, the base housing comprising a guide channel and a latch member;

a slide cam housing mounted on the base housing and including a first cam groove, a second cam groove, and a projection guide track, the slide cam housing extending into the guide channel; and a cover housing pivotally mounted on the base housing, the cover housing having a cover housing projection engaged in the projection guide track and a latch member to engage the base housing latch member, rotating the cover housing from an open position to a closed position thereby engaging the cover housing projection in the projection guide track and further engaging the cover housing latch member and the base housing latch member wherein the rotation of the cover housing from an open position to a closed position is complete upon the cover housing rotating until the cover housing latch member engages the base housing latch member and the cover housing contacts an arcuate stop to prevent further travel of the cover housing; and sliding the slide cam housing from an open position to a closed position thereby engaging the first cam follower projection in the first cam groove and further engaging the second cam follower in the second cam groove thereby drawing the connection member into the base housing to a connected position.

40. The method of locking a connection member into secure electrical engagement with a housing member of claim 39, further comprising the step of sealing the connector and the housing to prevent liquid and vapor penetration.

41. The method of locking a connection member into secure electrical engagement with a housing member of claim 39, wherein prior to the inserting step, the housing member is moved to a hold-open position by engaging a hold-open detent on a slide cam housing in a hold-open detent receiving portion of a cover housing.

42. The method of locking a connection member into secure electrical engagement with a housing member of claim 39, wherein the step of sliding the slide cam housing from an open position to a closed position is complete upon sliding the slide cam housing until the slide cam housing reaches a lateral stop.

43. The method of locking a connection member into secure electrical engagement with a housing member of claim 42, wherein the projection guide tracks are linear thereby providing a substantially constant mating force as the cover housing is rotated from an unmated position to a mated position.

44. A cover housing pivotally mounted on a base housing, the cover housing comprising a cover housing projection and further comprising arms pivoted on opposite sides of the base housing on a common axis and an operating member linking the arms for arcuate movement of the cover housing, the operating member and the base housing each having a latch member, the latch members being releasably engageable with each other to hold the operating member at one extreme end of the arcuate movement; and wherein the base housing guide channel includes an arcuate stop to prevent further travel of the cover housing.

45. The cover housing of claim 44, further comprising a hold-open lock mechanism to maintain the connector in a fully open position and prevent inadvertent closure of the cover housing.

46. The cover housing of claim 44, wherein the cover housing is sealed to prevent liquid and vapor penetration.

47. The cover housing of claim 44, wherein the cover housing includes a back wall that protects chambers, terminals, and wires when the cover housing is rotated to a mated position.

48. The cover housing of claim 44, wherein the cover housing latch member is integrally formed within the operating member of the cover housing.

49. The cover housing of claim 48, wherein the cover housing latch member is fully protected and concealed within the profile of the cover housing.

50. The cover housing of claim 49, further comprising a hold-open lock mechanism to maintain the connector in a fully open position and prevent inadvertent closure of the cover housing.

* * * * *

UNITED STATES PATENT AND TRADEMARK OFFICE
Certificate

Patent No. 7,070,438 B2 Patented: July 4, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Christopher J. Dillon, Farmington Hills, MI (US); and Ping Chen, Farmington Hills, MI (US).

Signed and Sealed this Twentieth Day of November 2007.

PAULA A. BRADLEY
*Supervisory Patent Examiner*
Art Unit 2833